US006910871B1

(12) United States Patent
Blume

(10) Patent No.: US 6,910,871 B1
(45) Date of Patent: Jun. 28, 2005

(54) VALVE GUIDE AND SPRING RETAINER ASSEMBLIES

(76) Inventor: George H. Blume, 107 Morning Cloud Cove, Austin, TX (US) 78734

( * ) Notice: Subject to any disclaimer, the term of this patent is extended or adjusted under 35 U.S.C. 154(b) by 161 days.

(21) Appl. No.: 10/613,295

(22) Filed: Jul. 3, 2003

Related U.S. Application Data

(63) Continuation-in-part of application No. 10/288,706, filed on Nov. 6, 2002, now Pat. No. 6,623,259.

(51) Int. Cl.[7] ..... F04B 39/00; F04B 53/00; F16K 15/00; F16J 10/00

(52) U.S. Cl. ..... 417/571; 417/454; 417/571; 417/568; 137/512; 137/543.23; 92/169.1

(58) Field of Search ..... 417/454, 571, 417/568; 137/512, 543.23; 92/169.1

(56) References Cited

U.S. PATENT DOCUMENTS 5,145,340 A * 9/1992 Allard ..... 417/568
5,622,486 A * 4/1997 McDuffie et al. ..... 417/536

* cited by examiner

*Primary Examiner*—Cheryl Tyler
*Assistant Examiner*—Christopher H. Orders
(74) *Attorney, Agent, or Firm*—Dennis W. Gilstad

(57) ABSTRACT

Valve guide and spring retainer assemblies are described for use in plunger pump housings that incorporate structural features for stress-relief. These pump housing structural features accommodate correspondingly-shaped valve guides and/or spring retainers that are internally fixed in place using one or more non-threaded spacers. Plunger pumps so constructed are relatively resistant to fatigue failure because of stress reductions, and they may incorporate a variety of valve styles, including top and lower stem-guided valves and crow-foot-guided valves, in easily-maintained configurations. Besides securing valve guides and/or spring retainers, non-threaded spacers may be shaped and dimensioned to aid in further reducing stress and to improve volumetric efficiency of the pumps in which they are used.

27 Claims, 19 Drawing Sheets

(Section B-B of Figure 7A)

(Section B-B of Figure 8A (Section C-C of Figure 8B)

(Section D-D of Figure 8B)

(Section E-E of Figure 8B (Section F-F of Figure 8B (Section B-B of Figure 9A)

(Section B-B of Figure 10A (Section C-C of Figure 10B)

(Section D-D of Figure 10B)

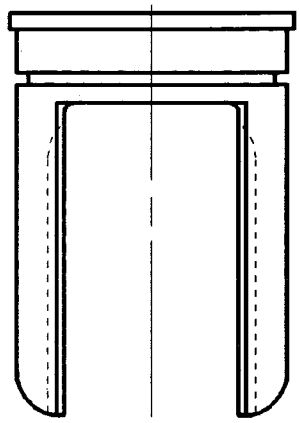
Figure 11C
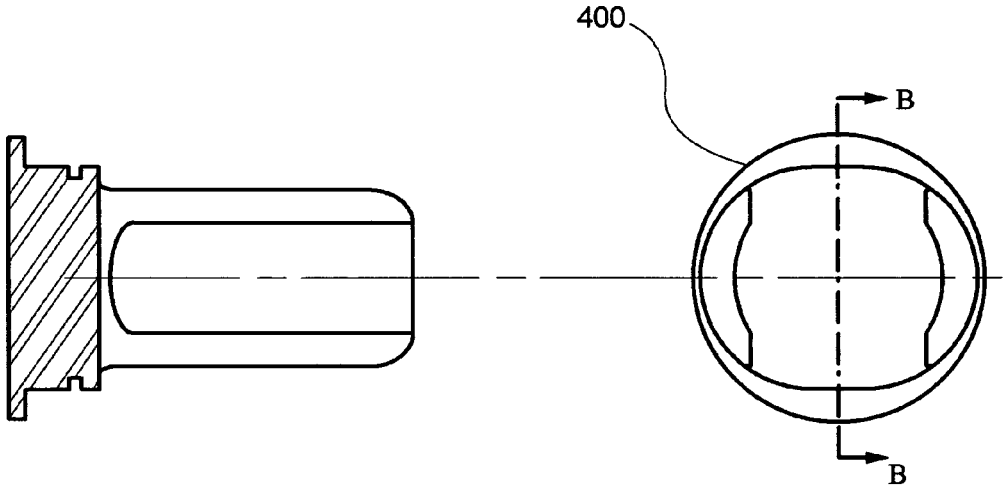
(Section B-B of Figure 11A)
Figure 11B
Figure 11A (Section B-B of Figure 12A)

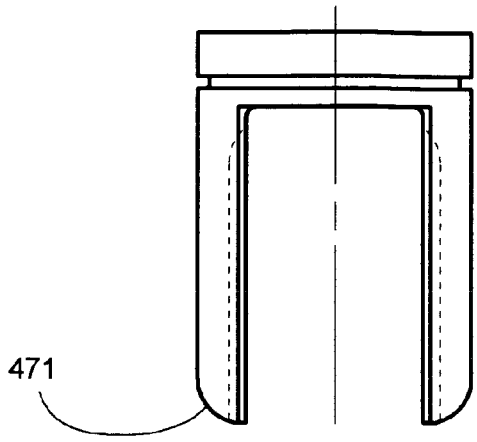
Figure 13C
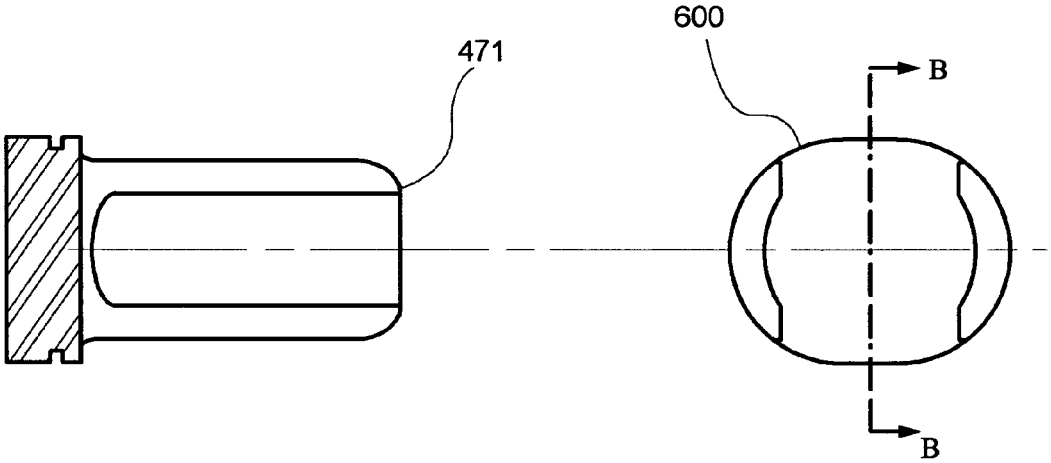
(Section B-B of Figure 13A)
Figure 13B
Figure 13A

VALVE GUIDE AND SPRING RETAINER ASSEMBLIES

This is a continuation-in-part (CIP) of U.S. patent application Ser. No. 10/288,706, filed Nov. 6, 2002, now U.S. Pat. No. 6,623,259 as amended.

FIELD OF THE INVENTION

The invention relates generally to high-pressure plunger pumps used, for example, in oil field operations. More particularly, the invention relates to valve guides and spring retainers for use in plunger pump housings that incorporate structural features for stress-relief and for accommodating valve guide and/or spring retainer assemblies.

BACKGROUND

Engineers typically design high-pressure oil field plunger pumps in two sections; the (proximal) power section and the (distal) fluid section. The power section usually comprises a crankshaft, reduction gears, bearings, connecting rods, crossheads, crosshead extension rods, etc. Commonly used fluid sections usually comprise a plunger pump housing having a suction valve in a suction bore, a discharge valve in a discharge bore, an access bore, and a plunger in a plunger bore, plus high-pressure seals, etc. FIG. 1 is a cross-sectional schematic view of a typical fluid section showing its connection to a power section by stay rods. A plurality of fluid sections similar to that illustrated in FIG. 1 may be combined, as suggested in the Triplex fluid section design schematically illustrated in FIG. 2.

Valve terminology varies according to the industry (e.g., pipeline or oil field service) in which the valve is used. In some applications, the term "valve" means just the moving element or valve body, whereas the term "valve" as used herein includes the valve body, the valve seat, one or more valve guides to control the motion of the valve body, and one or more valve springs that tend to hold the valve closed (i.e., with the valve body reversibly sealed against the valve seat).

Each individual bore in a plunger pump housing is subject to fatigue due to alternating high and low pressures which occur with each stroke of the plunger cycle. Plunger pump housings typically fail due to fatigue cracks in one of the areas defined by the intersecting suction, plunger, access and discharge bores as schematically illustrated in FIG. 3.

To reduce the likelihood of fatigue cracking in the high pressure plunger pump housings described above, a Y-block housing design has been proposed. The Y-block design, which is schematically illustrated in FIG. 4, reduces stress concentrations in a plunger pump housing such as that shown in FIG. 3 by increasing the angles of bore intersections above 90°. In the illustrated example of FIG. 4, the bore intersection angles are approximately 120°. A more complete cross-sectional view of a Y-block plunger pump fluid section is schematically illustrated in FIG. 5.

Although several variations of the Y-block design have been evaluated, none have become commercially successful for several reasons. One reason is that mechanics find field maintenance on Y-block fluid sections difficult. For example, replacement of plungers and/or plunger packing is significantly more complicated in Y-block designs than in the earlier designs represented by FIG. 1. In the earlier designs, provision is made to push the plunger distally through the cylinder bore and out through an access bore (labeled the suction valve/plunger cover in FIG. 1). This operation, which would leave the plunger packing easily accessible from the proximal end of the cylinder bore, is impossible in a Y-block design.

Thus the Y-block configuration, while reducing stress in a plunger pump housing relative to earlier designs, is associated with significant disadvantages. However, new high pressure plunger pump housings that provide both improved internal access and superior stress reduction are described in copending U.S. patent application Ser. No. 10/288,706, as amended, which is incorporated herein by reference (hereinafter the '706 application). One embodiment of the invention of the '706 application is schematically illustrated in FIG. 6. It includes a right-angular plunger pump housing comprising a suction valve bore (suction bore), discharge valve bore (discharge bore), plunger bore and access bore. The suction and discharge bores each have a portion with substantially circular cross-sections for accommodating a valve body and valve seat with substantially circular cross-sections. Note that the illustrated portions of the suction and discharge bores that accommodate a valve seat are slightly conical to facilitate substantially leak-proof and secure placement of each valve seat in the pump housing (e.g., by press-fitting). Less commonly, the portions of suction and discharge bores intended to accommodate a valve seat are cylindrical instead of being slightly conical. Further, each bore (i.e., suction, discharge, access and plunger bores) comprises a transition area for interfacing with other bores.

The plunger bore of the right-angular plunger pump housing of FIG. 6 comprises a cylinder bore having a proximal packing area (i.e., an area relatively nearer the power section) and a distal transition area (i.e., an area relatively more distant from the power section). Between the packing and transition areas is a right circular cylindrical area for accommodating a plunger. The transition area of the cylinder bore facilitates interfaces with analogous transition areas of other bores as noted above.

Each bore transition area of the right-angular pump housing of FIG. 6 has a stress-reducing feature comprising an elongated (e.g., elliptical or oblong) cross-section that is substantially perpendicular to each respective bore's longitudinal axis. Intersections of the bore transition areas are chamfered, the chamfers comprising additional stress-reducing features. Further, the long axis of each such elongated cross-section is substantially perpendicular to a plane that contains, or is parallel to, the longitudinal axes of the suction, discharge, access and cylinder bores.

An elongated suction bore transition area, as described in the '706 application, can simplify certain plunger pump housing structural features needed for installation of a suction valve (including its valve spring and valve spring retainer). Specifically, the valve spring retainer of a suction valve installed in such a plunger pump housing does not require a retainer arm projecting from the housing. Nor do threads have to be cut in the housing to position the retainer that secures the suction valve seat. Benefits arising from the absence of a suction valve spring retainer arm include stress reduction in the plunger pump housing and simplified machining requirements. Further, the absence of threads associated with a suction valve seat retainer in the suction bore eliminates the stress-concentrating effects that would otherwise be associated with such threads.

Threads can be eliminated from the suction bore if the suction valve seat is inserted through the suction bore transition area and press-fit into place as described in the '706 application. Following this, the suction valve body can also be inserted through the suction bore transition area. Finally, a valve spring is inserted via the suction bore transition area and held in place by an oblong suction valve spring retainer, an example of which is described in the '706 application. Note that the '706 application illustrates an oblong suction valve spring retainer having a guide hole (for a top-stem-guided valve body), as well as an oblong suction valve spring retainer without a guide hole (for a crow-foot-guided valve body). Both of these oblong spring retainer embodiments are secured in a pump housing of the '706 application by clamping about an oblong lip, the lip being a structural feature of the housing (see FIG. 6).

The '706 application also shows how discharge valves can be mounted in the fluid end of a high-pressure pump incorporating positive displacement pistons or plungers. For well service applications both suction and discharge valves typically incorporate a traditional full open seat design with each valve body having integral crow-foot guides. This design has been adapted for the high pressures and repetitive impact loading of the valve body and valve seat that are seen in well service. However, stem-guided valves with full open seats could also be considered for well service because they offer better flow characteristics than traditional crow-foot-guided valves. But in a full open seat configuration stem-guided valves require guide stems on both sides of the valve body (i.e., "top" and "lower" guide stems) to maintain proper alignment of the valve body with the valve seat during opening and closing. Unfortunately, designs incorporating secure placement of guides for both top and lower valve guide stems have been associated with complex components and difficult maintenance.

SUMMARY OF THE INVENTION

The current invention includes methods and apparatus related to valve stem guide and spring retainer assemblies and to plunger pump housings in which they are used. Typically, such plunger pump housings incorporate one or more of the stress-relief structural features described herein, plus one or more additional structural features associated with use of valve stem guide and spring retainer assemblies in the housings.

Examples of plunger pump housings incorporating such stress-relief structural features comprise substantially right-angular housings having substantially in-line (i.e., opposing) suction and discharge bores, plus substantially in-line (i.e., opposing) plunger and access bores. Where indicated as being collinear and/or coplanar, bore centerlines (or longitudinal axes) may vary somewhat from these precise conditions, due for example to manufacturing tolerances, while still substantially reflecting advantageous structural features of the present invention. The occurrence of such variations in certain manufacturing practices means that plunger pump housing embodiments of the present invention may vary somewhat from a precise right-angular configuration. Such plunger pump housings substantially reflect advantageous structural features of the present invention notwithstanding angles between the centerlines or longitudinal axes of adjacent bores that are within a range from approximately 85 degrees to approximately 95 degrees. Where the lines and/or axes forming the sides of such an angle to be measured are not precisely coplanar, the angle measurement is conveniently approximated using projections of the indicated lines and/or axes on a single plane in which the projected angle to be approximated is maximized.

Illustrated embodiments of valve stem guide and spring retainer assemblies of the present invention include, for example, a combination comprising structures to facilitate a discharge valve lower stem guide (DVLSG) function, plus a suction valve top stem guide and spring retainer (SVTSG-SR) function, plus a spacing function for spacing the DVLSG structures a predetermined distance apart from the SVTSG-SR structures. Alternative embodiments of the invention comprise other combinations of structural features to facilitate, for example, spring retainer and spacing functions with or without associated valve guide functions.

An illustrated embodiment of a plunger pump housing for use with valve stem guide and spring retainer assemblies of the present invention comprises a suction valve bore having a portion with substantially circular cross-sections for accommodating a circular suction valve, a cylindrical transition area, a shoulder corresponding to a suction valve top stem guide and spring retainer shoulder mating surface, and a first centerline. Analogously, a discharge valve bore has a portion with substantially circular cross-sections for accommodating a circular discharge valve, a cylindrical transition area, a shoulder corresponding to a discharge valve lower stem guide shoulder mating surface, and a second centerline. The first and second centerlines are collinear.

Illustrated embodiments of a plunger pump housing for use with valve stem guide and spring retainer assemblies of the present invention also comprise a cylinder bore having a proximal packing area and a distal transition area, the packing area having a substantially circular cross-section and a third centerline. The third centerline is coplanar with the first and second centerlines.

Illustrated embodiments of a plunger pump housing for use with valve stem guide and spring retainer assemblies of the present invention further comprise an access bore having a portion with substantially circular cross-sections for accommodating an access bore cover plug retainer, as well as a cylindrical transition area with elongated cross-sections that facilitates access to interior portions of the plunger pump housing. The access bore has a fourth centerline that is colinear with the third centerline.

Illustrated embodiments show that the suction valve bore transition area has an elongated cross-section substantially perpendicular to the first centerline and with a long axis substantially perpendicular to a plane containing the first, second, third and fourth centerlines. Analogously, the discharge valve bore transition area has an elongated cross-section substantially perpendicular to the second centerline and with a long axis substantially perpendicular to a plane containing the first, second, third and fourth centerlines. Analogously, the cylinder bore transition area has elongated cross-sections substantially perpendicular to said third centerline and with a long axis substantially perpendicular to a plane containing said first, second, third and fourth centerlines. And analogously, the access bore transition area has elongated cross-sections substantially perpendicular to said fourth centerline, each said elongated access bore cross-section having a long axis substantially perpendicular to a plane containing said first, second, third and fourth centerlines. Note that each said bore transition area has at least one adjacent chamfer for smoothing bore interfaces.

A valve stem guide and spring retainer assembly of the present invention can be used in the above plunger pump housing. The assembly comprises a discharge valve lower stem guide (DVLSG) for placement substantially within a discharge bore transition area of the plunger pump housing, said DVLSG comprising a body having first and second ends and a transverse cross-section. The first end of the DVLSG body comprises a shoulder mating surface for mating with a corresponding shoulder within the discharge bore, and the second end of the DVLSG body comprises at least one lateral alignment groove, a centered cylindrical guide stem hole extending longitudinally between said first and second ends, and at least one fluid passage extending longitudinally between said first and second ends. As illustrated herein, the corresponding shoulder within the discharge bore is located at the junction of the portion having substantially circular cross-sections with the discharge bore's cylindrical transition area.

The above valve stem guide and spring retainer assembly further comprises a suction valve top stem guide and spring retainer (SVTSG-SR) for placement substantially opposite the above DVLSG and aligned with a suction bore transition area of the above plunger pump housing. The SVTSG-SR comprises a body having first and second ends and a transverse cross-section. The SVTSG-SR first end comprises a shoulder mating surface for mating with a corresponding shoulder within said suction bore, or a chamfer mating surface for mating with a chamfer adjacent to the suction bore. The SVTSG-SR second end comprises at least one lateral alignment groove for placement opposing said at least one DVLSG alignment groove to form at least one opposing lateral alignment groove pair. A centered cylindrical guide stem hole may be provided to accommodate a valve body's top guide stem. This guide stem hole extends longitudinally between said first and second SVTSG-SR ends. For applications not involving a valve body having a top guide stem (e.g., for use with a valve body having integral crow-foot guides), this guide stem hole may be eliminated. At least one fluid passage extends longitudinally between said first and second SVTSG-SR ends. As illustrated herein, the corresponding shoulder within the suction bore is located at the junction of the portion having substantially circular cross-sections with the suction bore's cylindrical transition area.

The above valve stem guide and spring retainer assembly further comprises at least one side spacer having first and second parallel edges for insertion between grooves of the above at least one opposing lateral alignment groove pair. The first and second parallel edges are spaced apart sufficiently to assure that, upon insertion, simultaneous mating between shoulder mating surfaces of the DVLSG and shoulder or chamfer mating surfaces of the SVTSG-SR and corresponding pump housing shoulders or chamfers when the valve stem guide and spring retainer assembly is used in the above plunger pump housing.

Note that the DVLSG and the SVTSG-SR each have transverse cross-sections dimensioned to allow a close longitudinal sliding fit within, respectively, a corresponding oblong cylindrical discharge bore transition area and a corresponding oblong cylindrical suction bore transition area of the above plunger pump housing. Note also that each side spacer may be dimensioned to fit closely between the plunger pump housing and a plunger inserted for use within the housing. As further explained below, such close fitting of each side spacer can improve a pump's volumetric efficiency.

The above valve stem guide and spring retainer assembly is schematically illustrated with two lateral alignment groove pairs and two side spacers. Also illustrated is an access bore cover plug for covering the access bore. As illustrated herein, two side spacers may be attached to the access bore cover plug to hold them in position (i.e., spaced a predetermined distance apart as shown) for easy insertion between opposing lateral alignment groove pairs, or one or both side spacers may be unattached to the access bore cover plug.

Alternative embodiments of the present invention are disclosed below with reference to appropriate drawings.

BRIEF DESCRIPTION OF THE DRAWINGS

FIG. 11A schematically illustrates an end view of a flanged oblong access bore cover-plug with attached side spacers (see FIG. 8A).

FIG. 11B schematically illustrates the sectional view labeled B—B in FIG. 11A.

FIG. 11C schematically illustrates a side elevation of the oblong access bore cover-plug with attached side spacer shown in FIG. 11A.

FIG. 13A schematically illustrates an end view of a non-flanged oblong access bore cover-plug with attached side spacers (see FIGS. 9A and 9B).

FIG. 13B schematically illustrates the sectional view labeled B—B in FIG. 13A.

FIG. 13C schematically illustrates a side elevation of the oblong access bore cover-plug with separate side spacer shown in FIG. 13A.

DETAILED DESCRIPTION OF PREFERRED EMBODIMENTS

Figure 1:
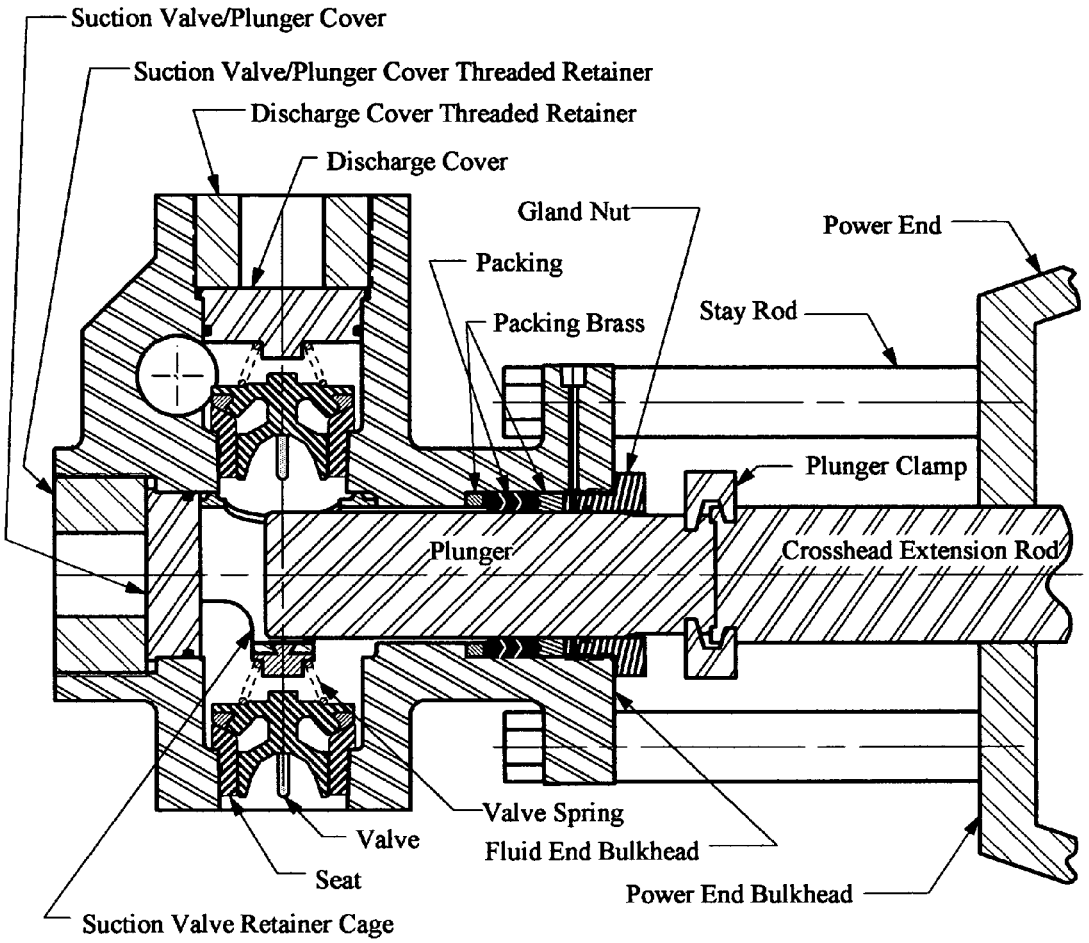
Prior Art Figure 1
FIG. 1 is a cross-sectional schematic view of a conventional plunger pump fluid section housing showing its connection to a power section by stay rods.
Figure 2:
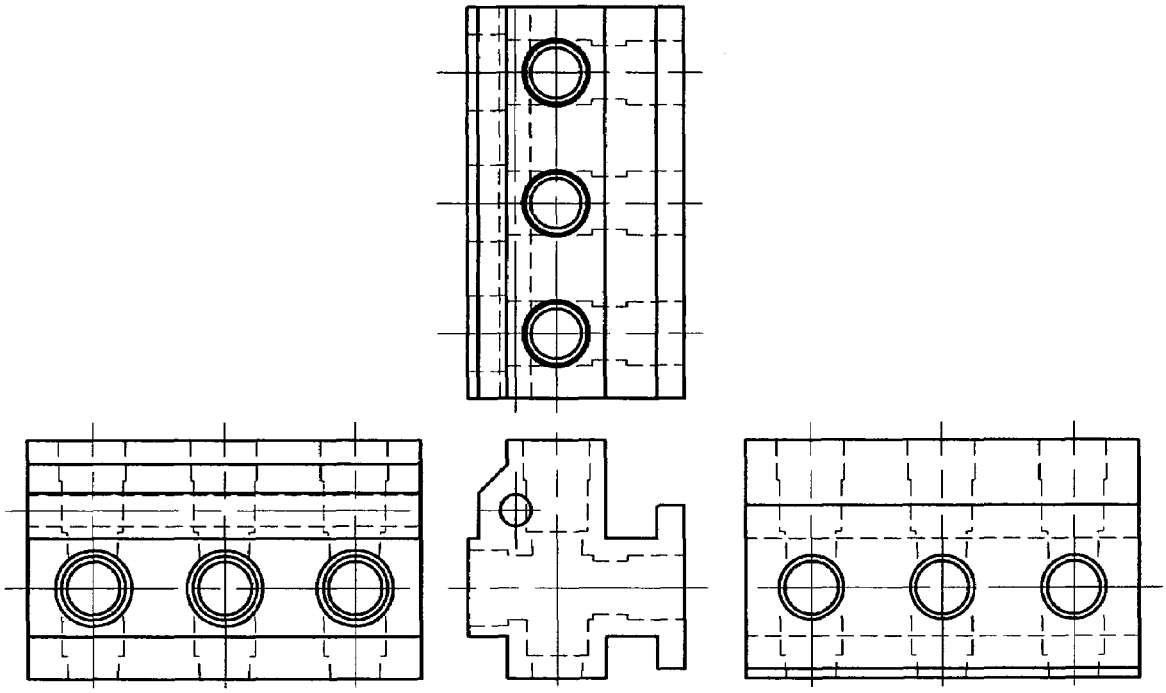
Prior Art Figure 2
FIG. 2 schematically illustrates a conventional Triplex plunger pump fluid section.
Figure 3:
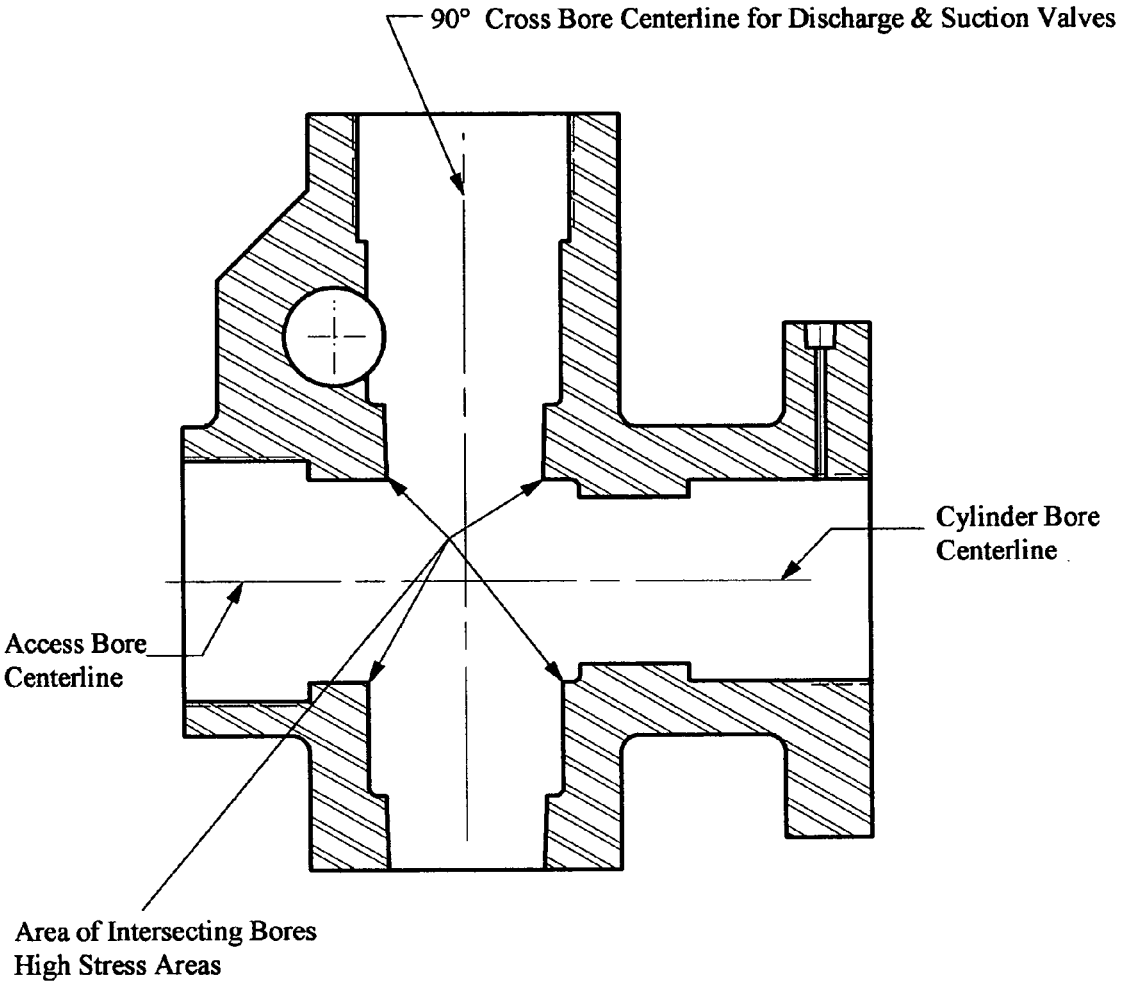
Prior Art Figure 3
FIG. 3 is a cross-sectional schematic view of suction, plunger, access and discharge bores of a conventional plunger pump housing intersecting at right angles showing areas of elevated stress.
Figure 4:
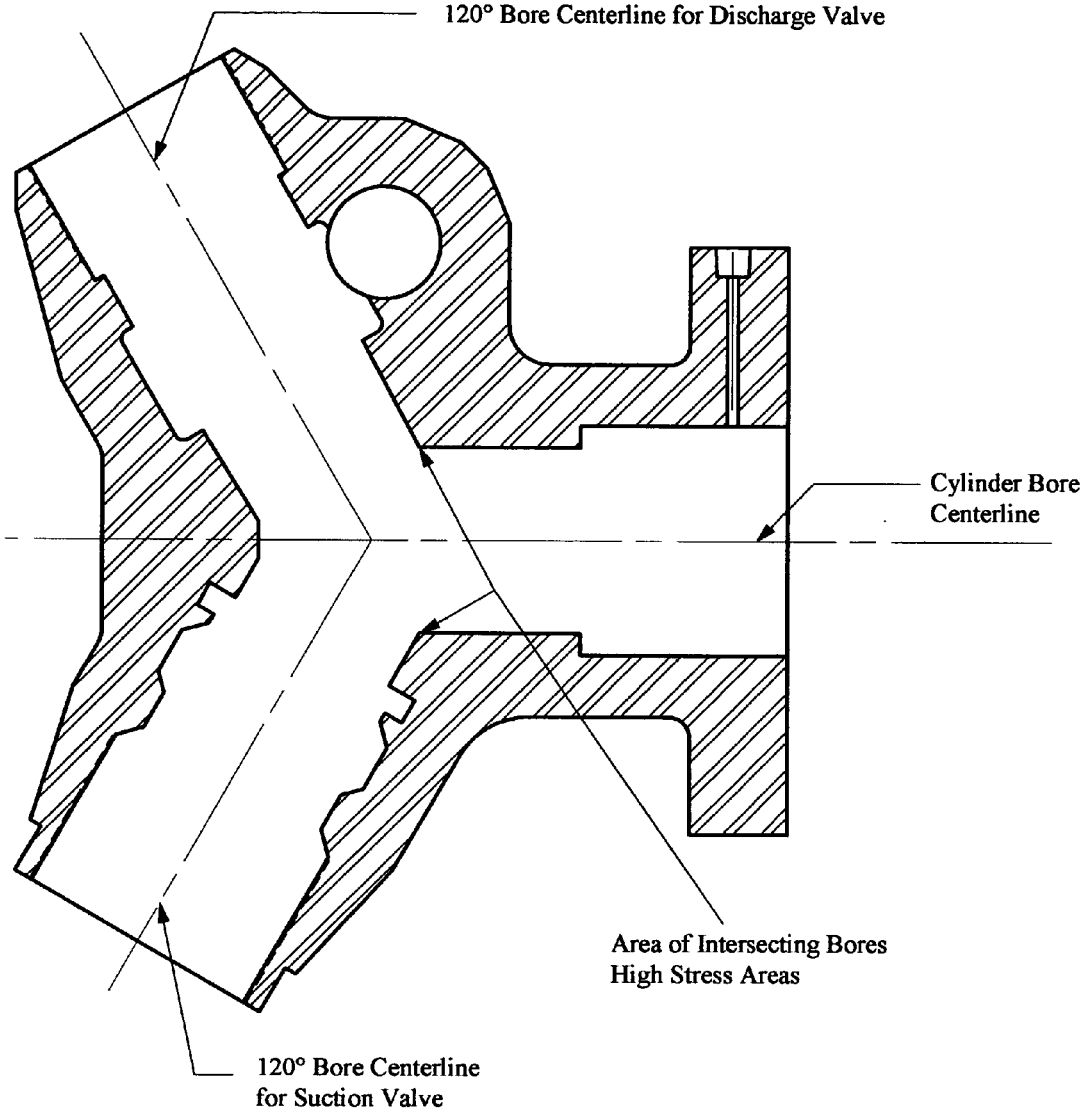
Prior Art Figure 4
FIG. 4 is a cross-sectional schematic view of suction, plunger and discharge bores of a Y-block plunger pump housing intersecting at obtuse angles showing areas of elevated stress.
Figure 5:
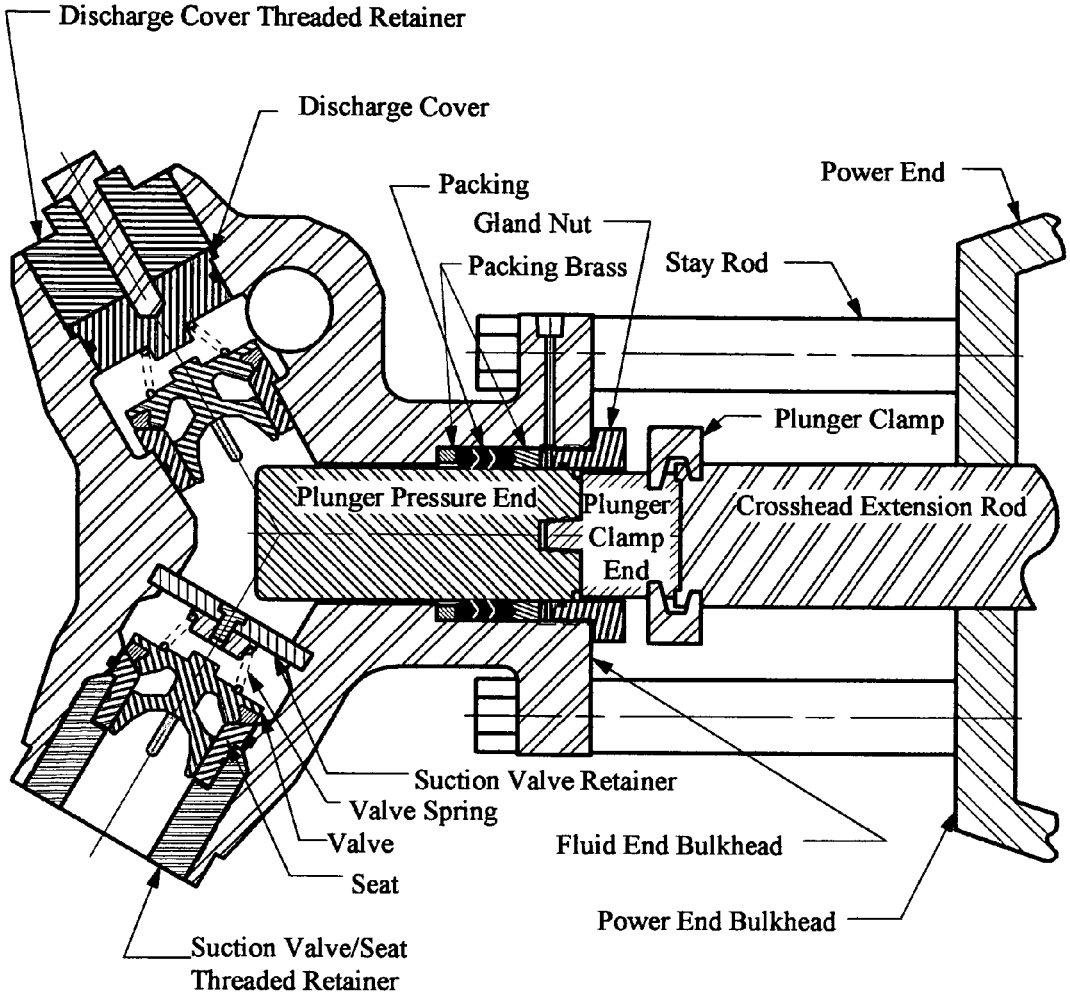
Prior Art Figure 5
FIG. 5 is a cross-sectional schematic view similar to that in FIG. 4, including internal plunger pump components.
Figure 6:
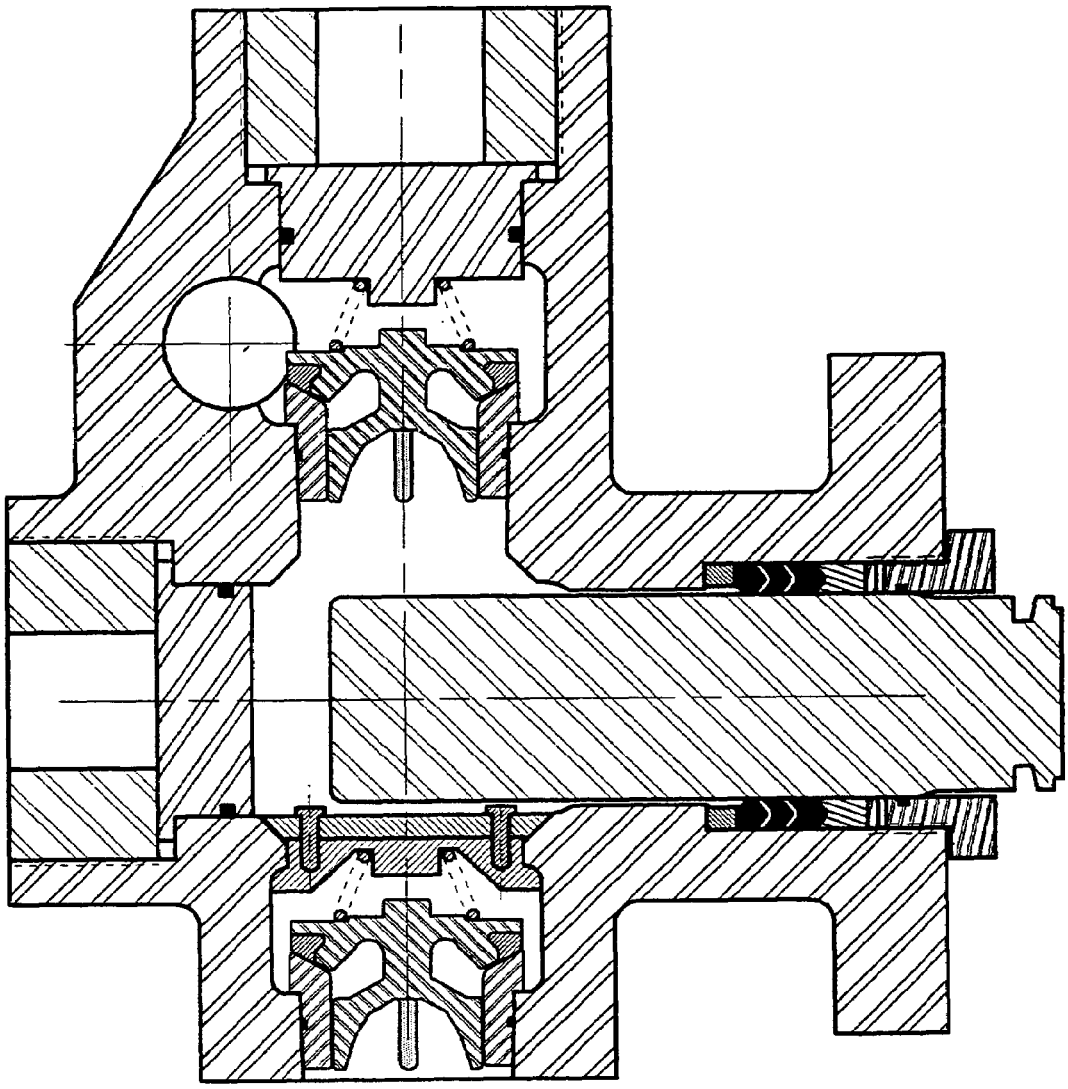
FIG. 6 schematically illustrates a cross-section of a right-angular plunger pump housing of the '706 application with valves, plunger, and a suction valve spring retainer clamped about a lip of the housing.
Figure 7A:
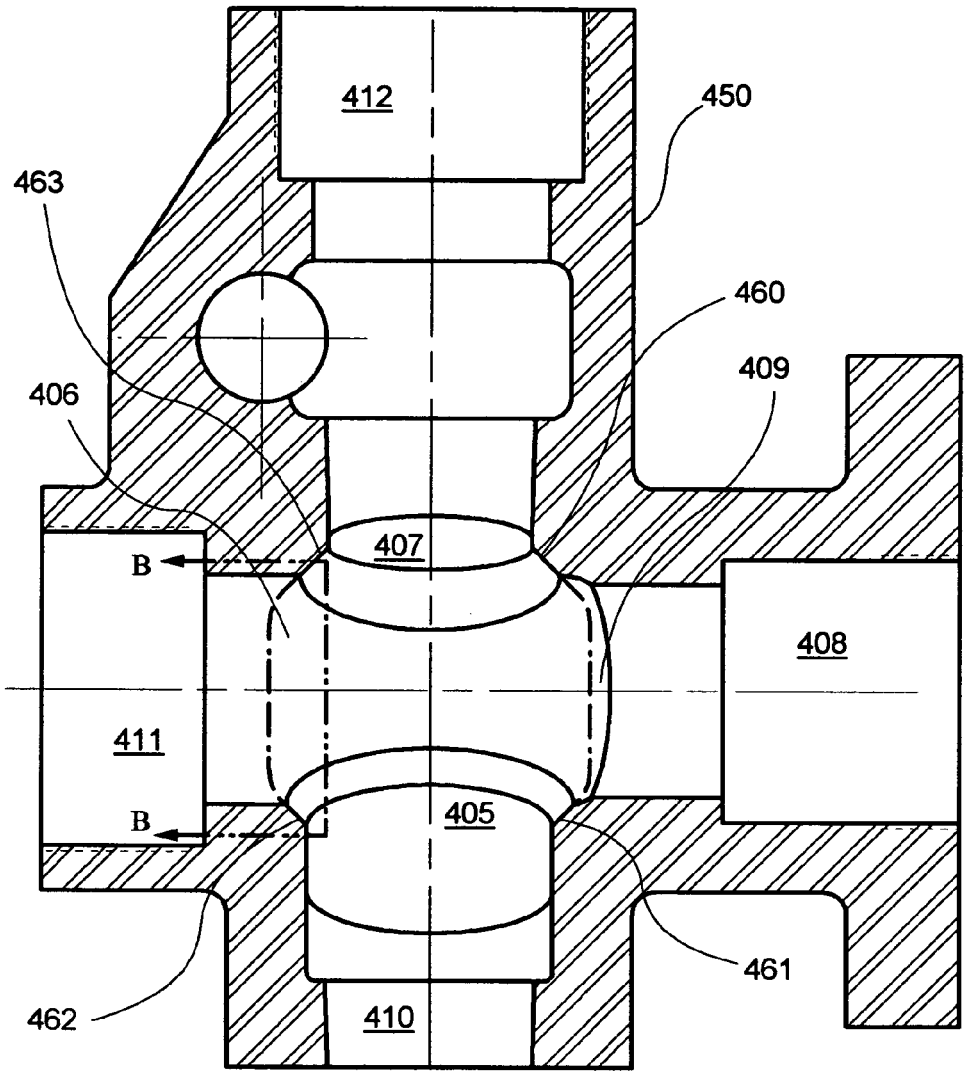
FIG. 7A schematically illustrates a cross-section of a right-angular plunger pump housing of the present invention. Note the absence of the housing lip shown in FIG. 6, as well as other structural differences described below.
Figure 7B:
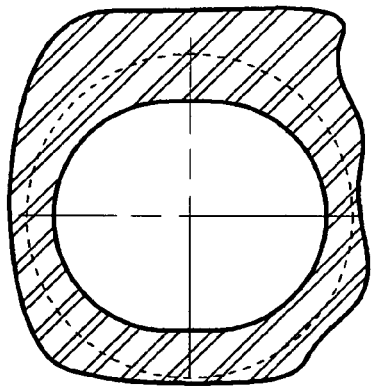
FIG. 7B schematically illustrates the sectional view labeled B—B in FIG. 7A.

FIGS. 7A and 7B schematically illustrate cross-sections of a right-angular pump housing 450 of the present invention, including a plunger bore 408 with its transition area 409, a suction bore 410 with its transition area 405, an access bore 411 with its transition area 406 and a discharge bore 412 with its transition area 407. The right-angular housing of FIG. 7A is analogous to that in FIG. 6, but without the housing lip shown securing the suction valve spring retainer in FIG. 6. While this lip has an oblong shape to reduce stress in the area near the lip, stress can be reduced even more if the lip is eliminated entirely and replaced by an oblong cylindrical transition area as seen in FIG. 8C, 8E or 10C. As described herein, valve guide and spring retainer assemblies of the present invention are designed in ways that reduce stress by eliminating the need for the lip.

The chamfers 460, 461, 462 and 463 shown in FIG. 7A are also stress-reducing features in pump housing 450 of the present invention. As schematically illustrated, these chamfers indicate portions of a barrel-shaped space that has been machined from the interior during manufacture of the pump housing 450. For clarification, the profile of this barrel-shaped space (barrel profile) is shown in heavy broken lines on FIG. 7A and discussed further below. Note that this space, which is shown as having a longitudinal axis coincident with the (vertical) centerline passing through the suction and discharge bores, has transverse cross-sections that are circular. Note also that machining the schematically illustrated barrel profile about the vertical centerline results in larger (i.e., more beneficial) barrel radii than machining an analogous (but smaller) barrel profile about the horizontal centerline (which is shown coincident with the common centerline of the access and plunger bores). Further, machining about either the horizontal or vertical centerlines as above produces more consistently beneficial results than the common industry practice of localized chamfering (e.g., chamfering about one or more axes laterally displaced from the respective centerlines).

While it is common design practice to generally call for chamfers at bore intersections, the radii of these chamfers cannot be reliably optimized by using rule-of-thumb approximations. Finite element analysis (FEA), on the other hand, provides means to quantify the benefits of, for example, using relatively larger barrel machining radii in the present invention. FEA shows that while use of the larger barrel radii removes relatively more material from the housing, it does not unduly increase stress elsewhere within the housing. In fact, modern computer-based FEA algorithms show that overall pump housing stress can be significantly reduced by the chamfers resulting from machining the relatively large internal barrel profile of the present invention.

This result is surprising because conventional wisdom suggests that removing material from the pump housing would tend to increase stress due to reduced wall thickness, and that removing more material would be associated with further increased housing wall stress. But FEA shows that for chamfers of the present invention the opposite is true. In fact, use of the large barrel profile allows for large chamfers, cut with relatively long radii, that both remove pump housing material and reduce stress in the high stress areas of the housing.

These combined benefits are obtained because the relatively large radii of the barrel machining profile result in removal of relatively large amounts of material from areas of the pump housing where stress is relatively low. Thus, there is little tendency for significant amounts of stress to be shifted to other parts of the pump housing. Note, however, that use of a large internal barrel machining profile as described above increases the amount of internal pump housing space that is not swept by movement of the plunger. And additional unswept internal pump housing space tends to reduce volumetric efficiency. As further described herein, however, this increase in unswept volume is effectively countered through use of side-spacers of the present invention to space apart a DVLSG and a SVTSG-SR, or to space apart a DVLSG and a suction valve spring retainer.

Figure 8A:
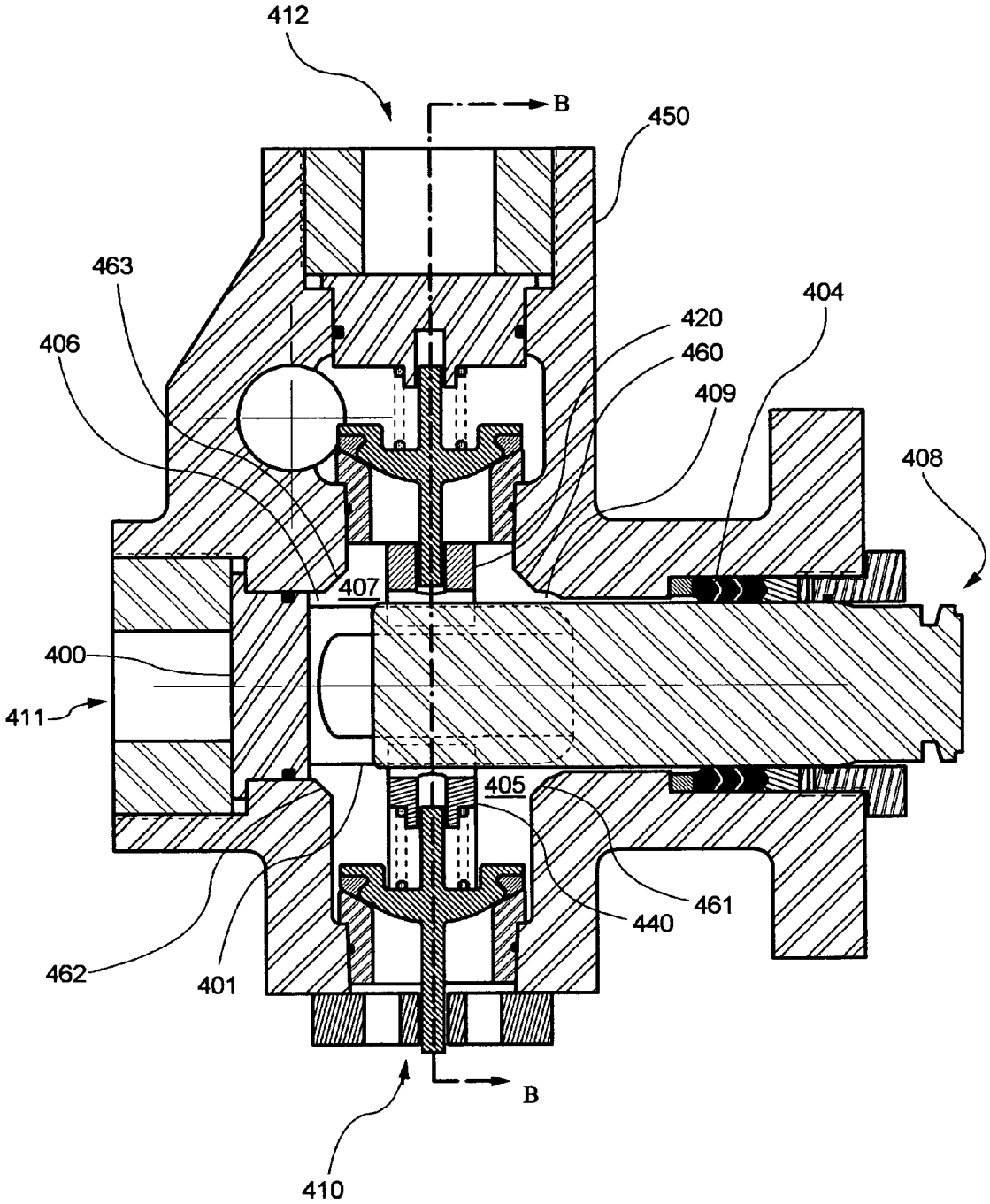
FIG. 8A schematically illustrates a cross-section of a right-angular plunger pump housing analogous to that of FIG. 7A, but including a plunger and stem-guided suction and discharge valves, a DVLSG and a SVTSG-SR with shoulder mating surfaces, plus a flanged oblong access bore cover-plug with attached side spacer inserted in the access bore.
Figure 8B:
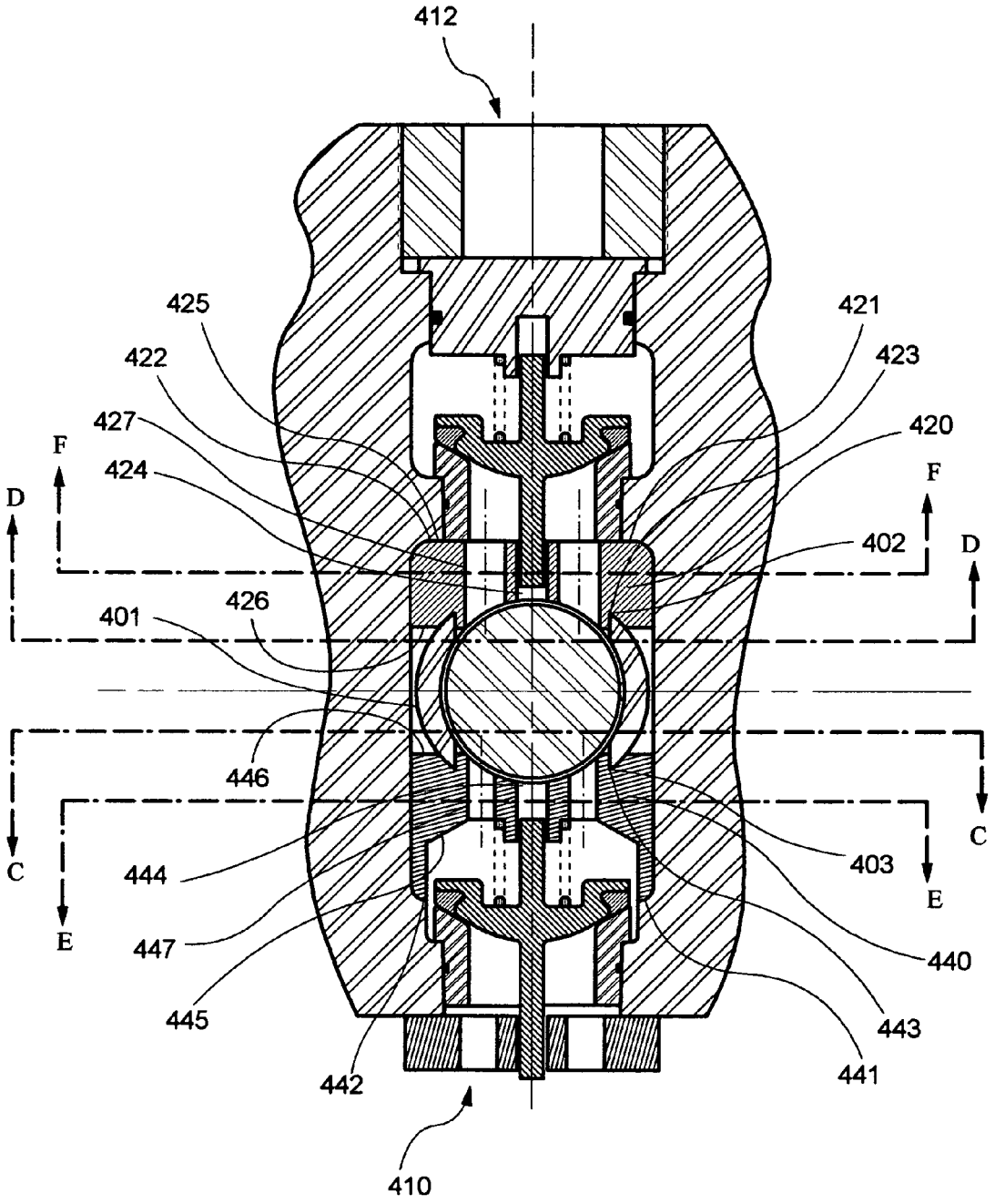
FIG. 8B schematically illustrates the sectional view labeled B—B in FIG. 8A.
Figure 8C:
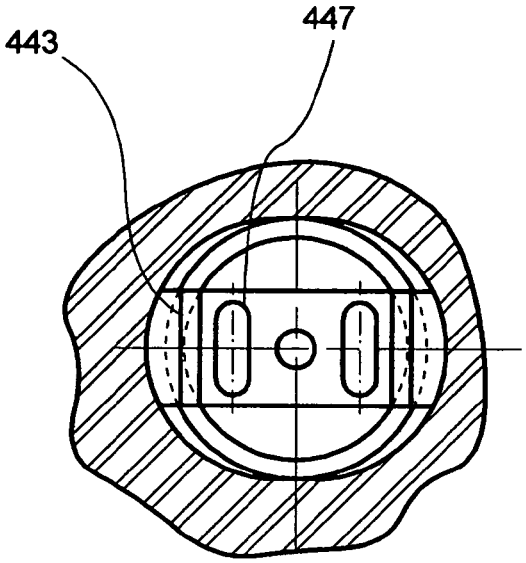
FIG. 8C schematically illustrates the transverse section labeled C—C in FIG. 8B.

FIGS. 8A and 8B schematically illustrate a right-angular pump housing 450 of the present invention which is analogous to the housing of FIGS. 7A and 7B but includes a plunger in cylinder bore 408, a stem-guided suction valve in suction valve bore 410, an oblong access bore cover plug 400 with attached side spacers 401 in access bore 411, and a stem-guided discharge valve in discharge valve bore 412. Additional structures shown in FIGS. 8A and 8B include a DVLSG body 420 and a SVTSG-SR body 440.

FIG. 8B shows the shoulder mating surfaces 421 and 441 on the respective first ends 425 and 445 of DVLSG body 420 and SVTSG-SR body 440. The respective second ends 426 and 446 of DVLSG body 420 and SVTSG-SR body 440 are seen to have opposing lateral alignment grooves 423 and 443 respectively forming two opposing lateral alignment groove pairs. Also seen in FIG. 8B are discharge bore shoulder 422 of pump housing 450 corresponding to DVLSG shoulder mating surface 421, as well as suction bore shoulder 442 of pump housing 450 corresponding to SVTSG-SR shoulder mating surface 441.

FIGS. 8A and 8B also show a cylindrical transition area 405 of suction valve bore 410 in which SVTSG-SR body 440 has a close longitudinal sliding fit. Analogously, FIGS.

8A and 8B also show a cylindrical transition area 407 of discharge valve bore 412 in which DVLSG body 420 has a close longitudinal sliding fit. Transition area 409 and packing area 404 of cylinder bore 408, plus transition area 406 of access bore 411 are shown in FIG. 8A, as are chamfers 460 and 461 adjacent to cylinder bore 408, chamfers 461 and 462 adjacent to suction valve bore 410, chamfers 462 and 463 adjacent to access bore 411, and chamfers 463 and 460 adjacent to discharge valve bore 412.

FIG. 8B shows centered cylindrical guide stem hole 424 and fluid passages 427 extending longitudinally between first end 425 and second end 426 of DVLSG body 420. Analogously, FIG. 8B shows centered cylindrical guide stem hole 444 and fluid passages 447 extending longitudinally between first end 445 and second end 446 of SVTSG-SR body 440. Also shown in FIG. 8B are two side spacers 401 with parallel edges 402 and 403, each side spacer 401 being for insertion between an opposing lateral alignment groove pair comprising a lateral alignment groove 423 in second end 426 of DVLSG body 420 opposite a lateral alignment groove 443 in second end 446 of SVTSG-SR body 440.

Figure 8D:
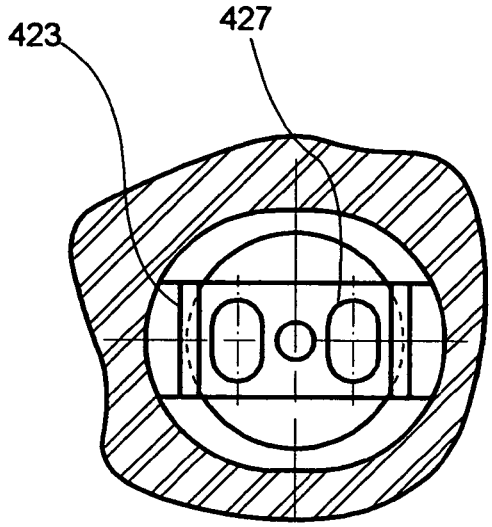
FIG. 8D schematically illustrates the transverse section labeled D—D in FIG. 8B.
Figure 8E:
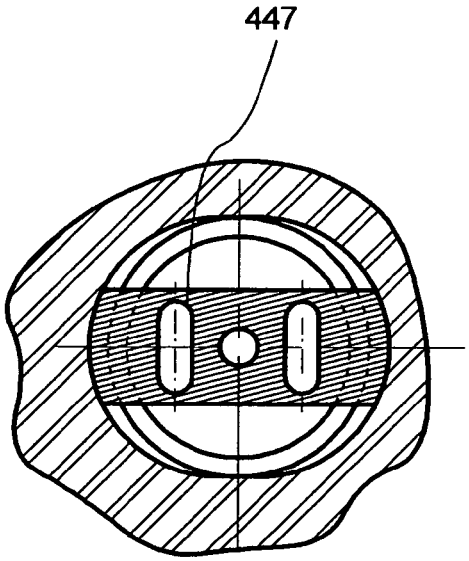
FIG. 8E schematically illustrates the transverse section labeled E—E in FIG. 8B.
Figure 8F:
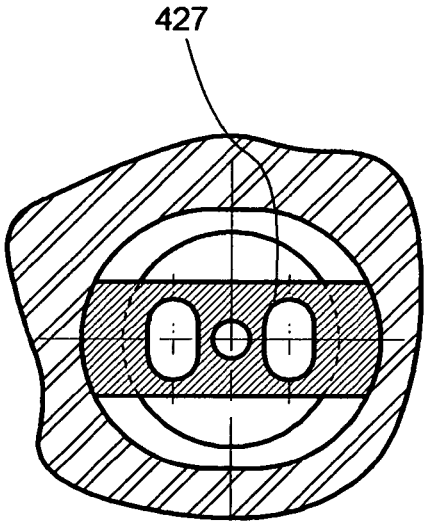
FIG. 8F schematically illustrates the transverse section labeled F—F in FIG. 8B.

FIG. 8C schematically illustrates the transverse section labeled C—C in FIG. 8B. FIG. 8D schematically illustrates the transverse section labeled D—D in FIG. 8B. FIG. 8E schematically illustrates the transverse section labeled E—E in FIG. 8B. FIG. 8F schematically illustrates the transverse section labeled F—F in FIG. 8B. FIG. 8C shows lateral alignment grooves 443 and fluid passages 447. FIG. 8D shows lateral alignment grooves 423 and fluid passages 427. FIGS. 8E and 8F show fluid passages 447 and 427 respectively. Compare the routes for fluid flow through, and on either side of, passages 447 and 427 (see FIGS. 8E and 8F respectively) with the more streamlined fluid flow routes through passages 547 and 527 (see FIGS. 10C and 10D respectively). Note, however, that a more significant reduction in fluid flow resistance in the embodiment of FIGS. 10A–D, relative to the embodiment of FIGS. 8A–F, is obtained because use of the chamfer mating surface 541 obviates the need for shoulder mating surface 441. Shoulder mating surface 441, when present, is relatively close to the suction valve body, so elimination of shoulder mating surface 441 increases the cross-sectional flow area near the suction valve body and causes a significant reduction in flow resistance for fluid flowing around the suction valve body.

Figure 9A:
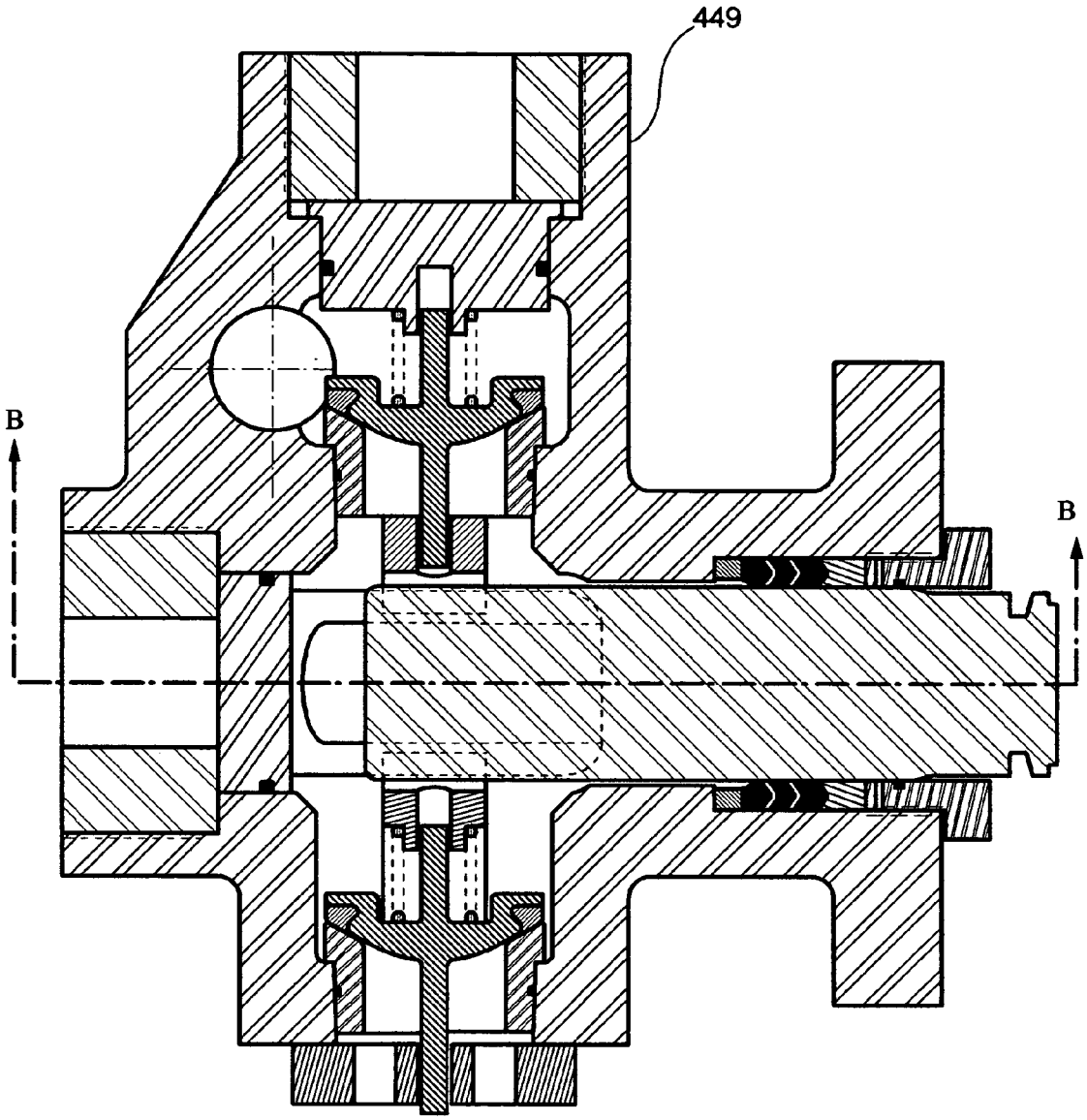
FIG. 9A schematically illustrates a cross-section of a right-angular plunger pump housing analogous to that of FIG. 8A, but including a non-flanged oblong access bore cover-plug with attached side spacer inserted in the access bore.
Figure 9B:
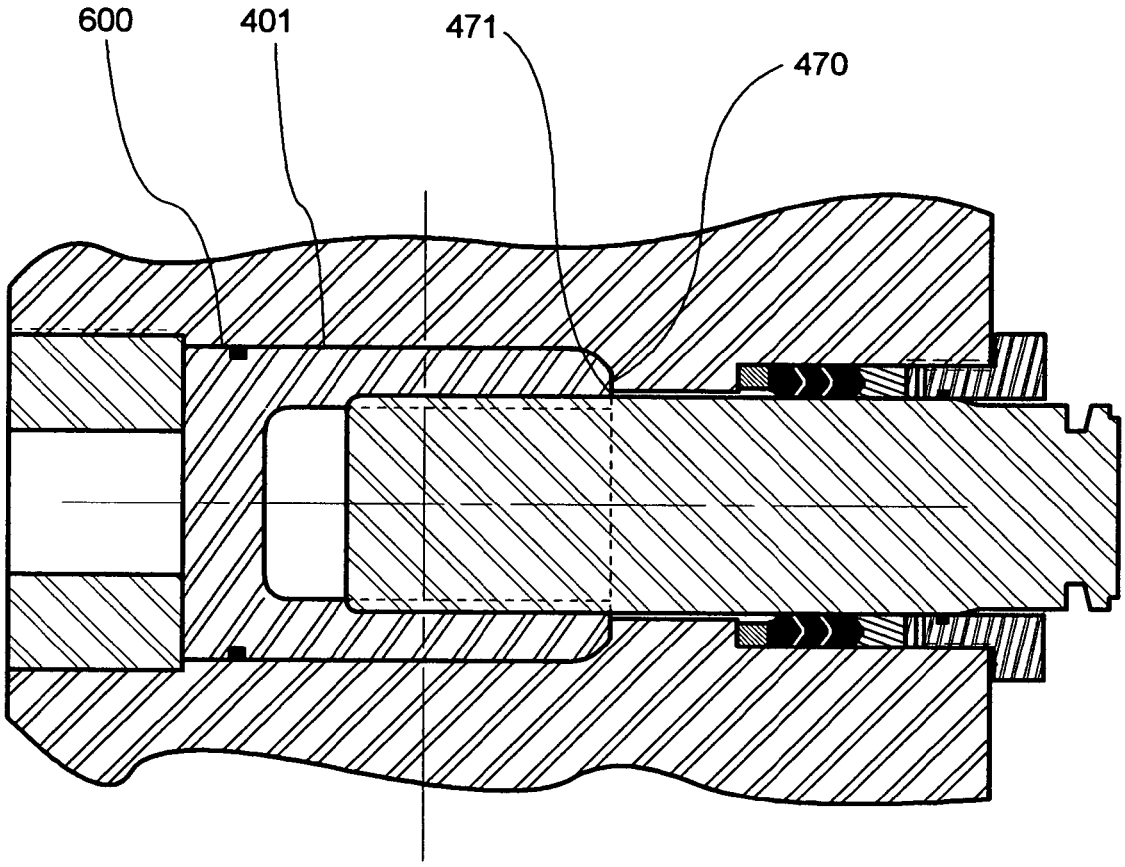
FIG. 9B schematically illustrates the cross-section labeled B—B in FIG. 9A, showing a non-flanged oblong access bore cover-plug with attached side spacer having a shoulder mating surface, as well as the corresponding pump housing shoulder.

FIGS. 9A and 9B schematically illustrate an alternative right-angular plunger pump housing 449 having an internal shoulder 470 for mating with shoulder mating surfaces 471 of side spacers 401 which are attached to non-flanged oblong access bore cover plug 600 (see FIGS. 13A, 13B and 13C). The lack of a flange on access bore cover plug 600 means that when internal pressure in plunger pump housing 449 is reduced (e.g., during a plunger's suction stroke), the tendency for cover plug 600 to be drawn further into housing 449 is resisted by contact between shoulder mating surfaces 471 and shoulder 470 of housing 449.

Thus, elimination of the flange on an access bore cover plug simultaneously eliminates a source of stress on the cover plug and a source of stress on the portion of the pump housing that would otherwise interface with the cover plug flange. And besides reducing stress on the cover plug, elimination of the flange makes the cover plug easier to machine. Further, a reduction of stress on the pump housing means that its design may be altered to require less material for its manufacture.

Figure 10A:
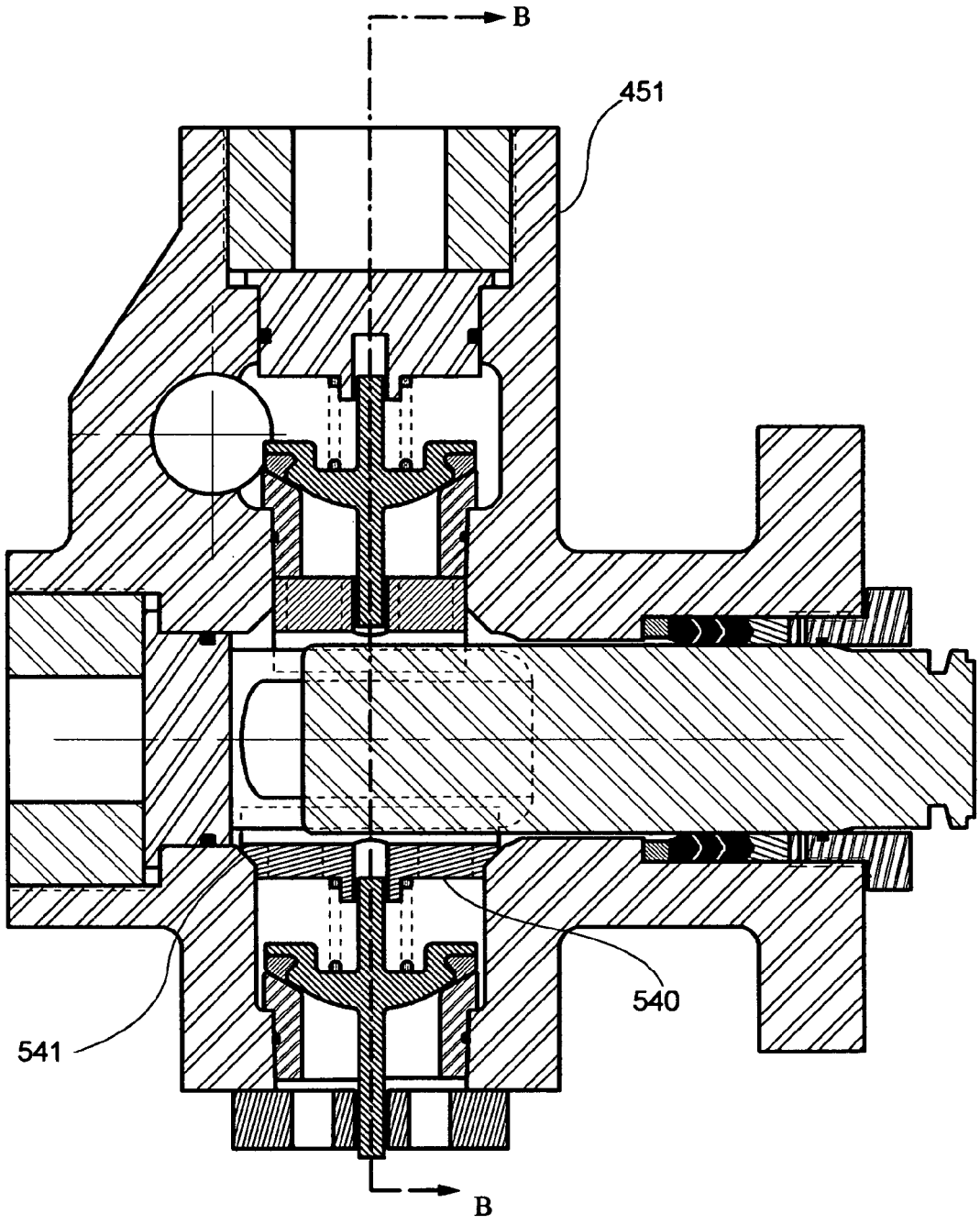
FIG. 10A schematically illustrates a cross-section of a right-angular plunger pump housing, together with a plunger and stem-guided suction and discharge valves, a DVLSG with shoulder mating surface, and a SVTSG-SR with chamfer mating surface, plus a flanged oblong access bore cover-plug with attached side spacer inserted in the access bore.
Figure 10B:
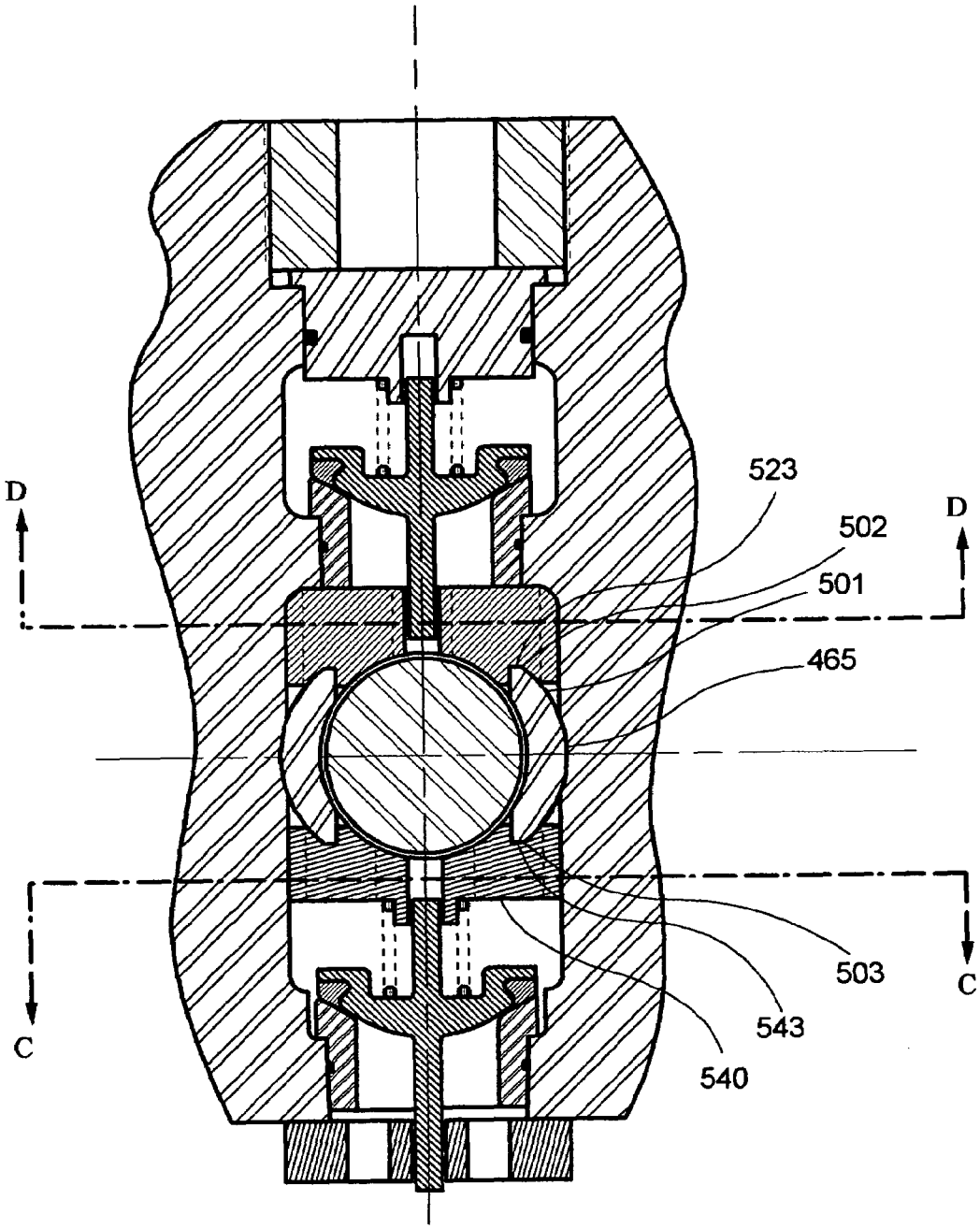
FIG. 10B schematically illustrates the sectional view labeled B—B in FIG. 9A.
Figure 10C:
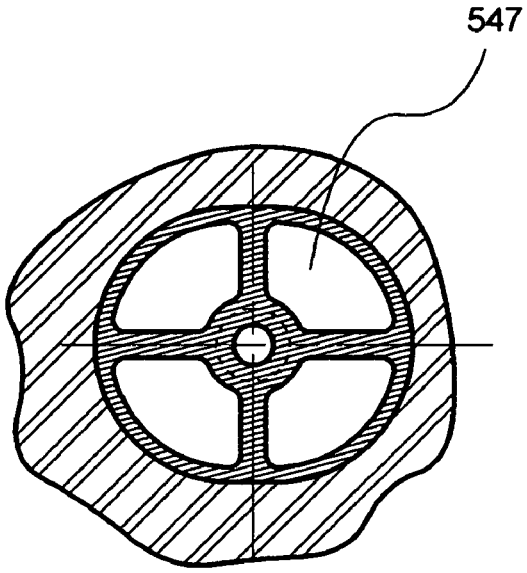
FIG. 10C schematically illustrates the sectional view labeled C—C in FIG. 9B.
Figure 10D:
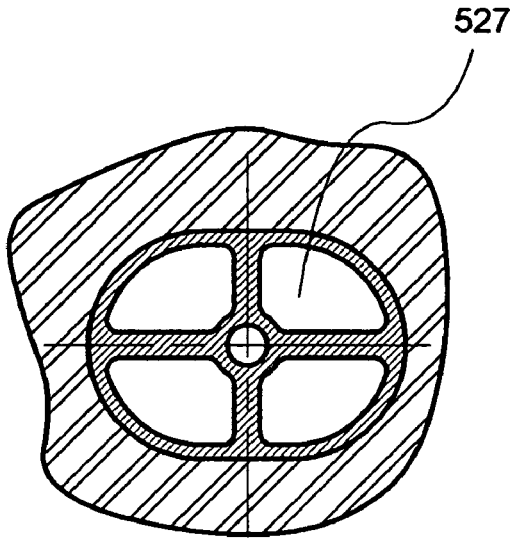
FIG. 10D schematically illustrates the sectional view labeled D—D in FIG. 9B.

FIGS. 10A and 10B schematically illustrate an alternative right-angular pump housing 451 of the present invention, analogous to pump housing 450 as shown in FIGS. 8A and 8B. Structural differences between pump housing 451 and 450, include the presence of recesses 465 which accommodate relatively thicker side spacers 501 with their parallel edges 502 and 503. Note also that parallel edges 502 and 503 are shaped differently (see FIG. 10B) from analogous parallel edges 402 and 403 of side spacers 401 (see FIG. 8B). Lateral alignment grooves 523 and 543 of SVTSG-SR body 540 (see FIG. 9B) accommodate parallel edges 502 and 503 in a manner analogous to accommodation of parallel edges 402 and 403 in lateral alignment grooves 423 and 443 (see FIG. 8B).

Another difference between the embodiment illustrated in FIGS. 8A and 8B compared to the embodiment illustrated in FIGS. 10A and 10B is in the structure of SVTSG-SR body 540. As shown in FIG. 10A, SVTSG-SR body 540 comprises a chamfer mating surface 541 instead of the shoulder mating surface 441 illustrated on SVTSG-SR body 440 in FIG. 8B. While either chamfer mating surface 541 or shoulder mating surface 441 facilitates aligning its respective SVTSG-SR body with respect to its respective suction bore, various pump operational parameters (e.g., flow rate or pressure), as well as particulars of manufacturing techniques (e.g., materials or heat treatments) may favor the use of a shoulder mating surface or a chamfer mating surface for a specific application. Note that the technique of suction bore chamfer mating in lieu of suction bore shoulder mating, as described above for pump housing 451, can be analogously applied for pump housing 450.

Figure 12C:
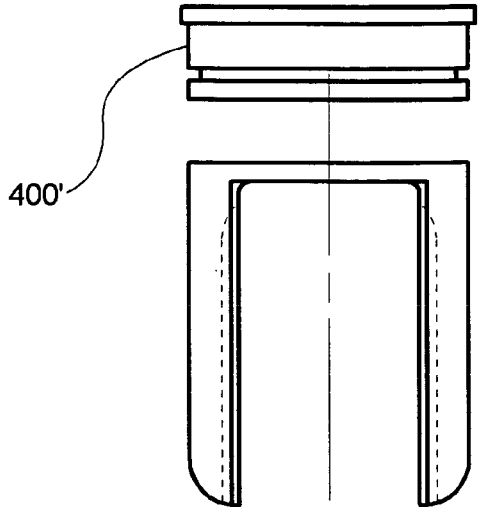
FIG. 12C schematically illustrates a side elevation of the oblong access bore cover-plug with separate side spacer shown in FIG. 12A.
Figure 12B:
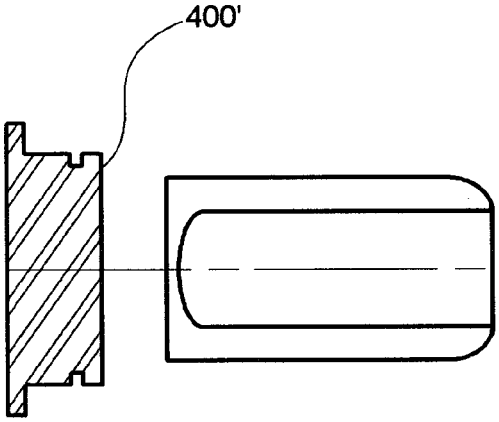
FIG. 12B schematically illustrates the sectional view labeled B—B in FIG. 12A.
Figure 12A:
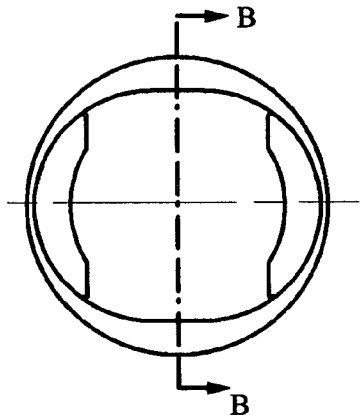
FIG. 12A schematically illustrates an end view of a flanged oblong access bore cover-plug with separate side spacers.

Regardless of the use of either suction bore chamfer mating or suction bore shoulder mating in a pump housing of the present invention, the spacing function of either embodiment 401 or 501 of side spacers remains as described herein. This function is accomplished whether side spacers are attached to a flanged access bore cover plug (see, e.g., plug 400 in FIGS. 11A–11C), or a non-flanged access bore cover plug (see, e.g., plug 600 in FIGS. 13A–13C), or are separated from an access bore cover plug (see, e.g., plug 400' in FIGS. 12A–12C).

Side spacers 501 are dimensioned to fit more closely between a plunger and the pump housing 451 (that is, to occupy more of the space between a plunger and the pump housing 451) relative to the analogous fit between a plunger and the pump housing 450. Note that FIG. 10B illustrates the portion of total internal space not swept by a plunger (unswept space) within pump housing 451 as being relatively smaller than the analogous unswept space illustrated in FIG. 8B. Thus, the ratio of swept space to total internal space (i.e., swept space plus unswept space) is relatively larger for pump housing 451 in FIG. 10B compared to the analogous ratio for pump housing 450 in FIG. 8B. The difference in these ratios means that the embodiment schematically represented in FIG. 10B has greater volumetric efficiency than the embodiment schematically represented in FIG. 8B.

As illustrated herein, each side spacer intended for use in a pump housing of the present invention may comprise a longitudinal concave surface having a slightly greater radius of curvature, and an extension of the same center line of curvature when in its functional position in a pump housing, as that of the right circular cylindrical portion of the plunger bore. The spacer is thus located so as to effectively longitudinally extend the right circular cylindrical portion of the plunger bore into the internal space of a pump housing on which the suction, discharge and access bore transition areas open. When so located, each side spacer occupies space that would otherwise comprise part of the volume within the pump housing which is unswept by the plunger. So each side spacer, when located in its functional position in a pump housing, effectively reduces the unswept volume of that housing and thereby increases the volumetric efficiency of the pump while simultaneously accomplishing its function of spacing apart the DVLSG and the SVTSG-SR (or the suction valve spring retainer in embodiments for use with valve bodies having integral crow-foot guides but no top guide stems). Side spacers secure stem guides and spring retainers in place by maintaining sufficient distance between their respective mating surfaces (e.g., between the shoulder mating surface of the DVLSG and either the shoulder mating surface or the chamfer mating surface of the SVTSG-SR). Volumetric efficiency is further enhanced when each side spacer is dimensioned to mate closely with the adjacent internal portions of pump housings of the present invention (see, e.g., FIG. 10B).

Figure 14:
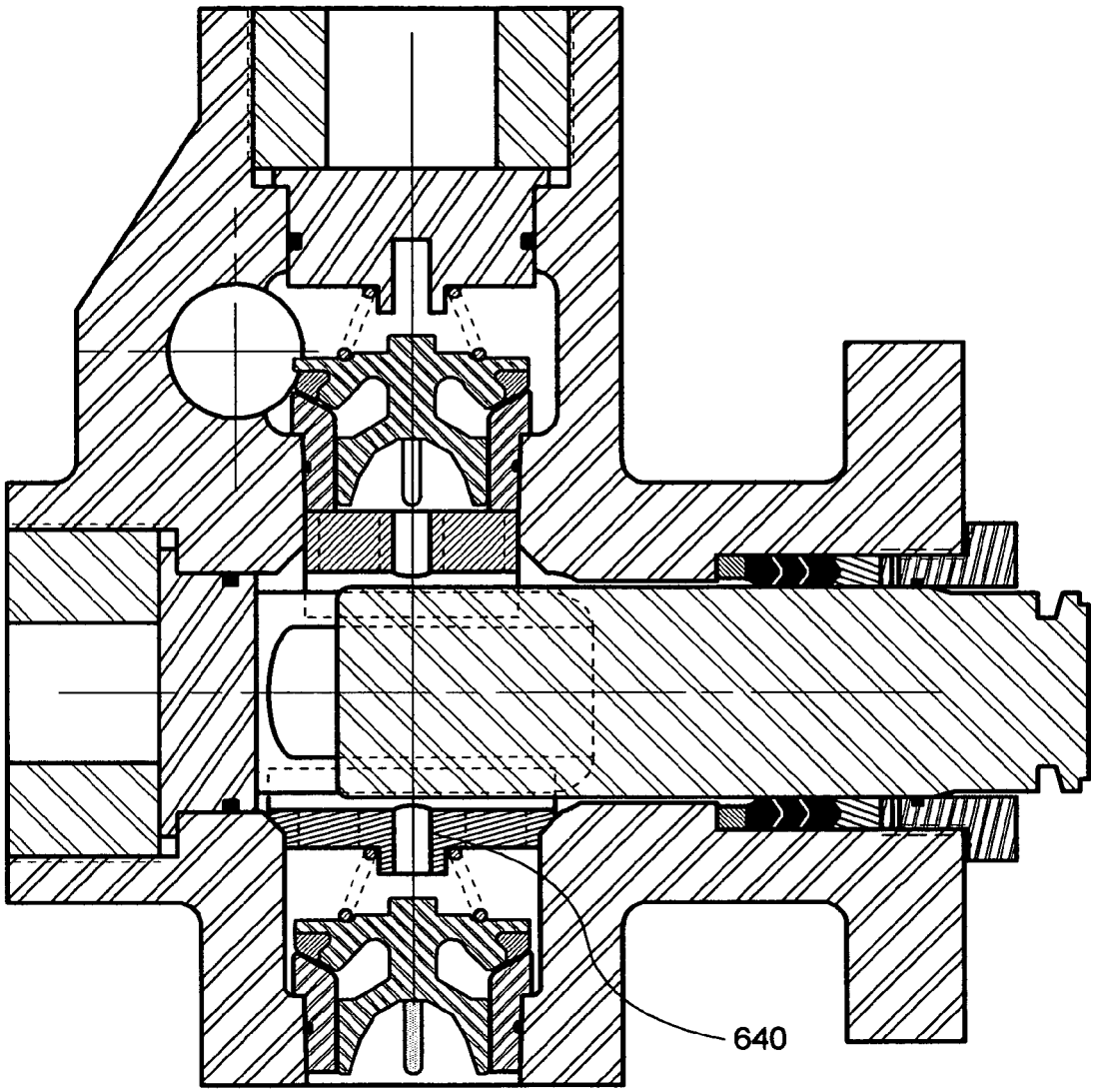
FIG. 14 schematically illustrates a cross-section of the right-angular plunger pump housing of FIG. 7A, together with a plunger and crow-foot-guided suction and discharge valves, a discharger valve stem guide body, and a suction valve spring retainer with chamfer mating surfaces, plus a flanged oblong access bore cover-plug with attached side spacer inserted in the access bore.

In the embodiments illustrated in FIGS. 8A, 8B, 10A and 10B, the DVLSG and the SVTSG-SR each have an elongated transverse cross-section, and they are dimensioned to allow a close sliding fit within, respectively, the cylindrical elongated discharge bore transition area and the cylindrical elongated suction bore transition area of a stress-relieved plunger pump housing. Further, the DVLSG and the SVTSG-SR each comprise a centered cylindrical longitudinal valve stem guide hole and at least one longitudinal fluid passage, each said fluid passage functioning to facilitate substantially longitudinal fluid flow through the DVLSG and the SVTSG-SR respectively. Note, however, that the use of a crow-foot guided suction valve body in a pump housing of the present invention (see FIG. 14) may obviate the need for centered cylindrical guide stem holes such as holes 424 and 444 in FIGS. 8A and 8B. If present in a suction valve spring retainer body such as 640 (see FIG. 14) or in a discharge valve stem guide body used with a crow-foot guided discharge valve (again see FIG. 14), such holes may function instead to further facilitate longitudinal fluid flow through the associated suction valve. Note also that use of a chamfer mating surface on a suction valve spring retainer as shown in FIG. 14 more significantly decreases longitudinal fluid flow resistance in the suction bore by eliminating the shoulder mating surface from the vicinity of the suction valve body (thus increasing fluid flow cross-sectional area in the vicinity of the suction valve body).

What is claimed is:

1. A plunger pump housing for use with a valve stem guide and spring retainer assembly, the plunger pump housing comprising:

a suction valve bore having a portion with substantially circular cross-sections for accommodating a circular suction valve, a cylindrical transition area, a shoulder corresponding to a suction valve top stem guide and spring retainer shoulder mating surface, and a first centerline;

a discharge valve bore having a portion with substantially circular cross-sections for accommodating a circular discharge valve, a cylindrical transition area, a shoulder corresponding to a discharge valve lower stem guide shoulder mating surface, and a second centerline, said first and second centerlines being colinear;

a cylinder bore having a proximal packing area and a distal transition area, said packing area having a substantially circular cross-section and a third centerline, said third centerline being coplanar with said first and second centerlines; and an access bore having a cylindrical transition area with elongated cross-sections for facilitating access to interior portions of the plunger pump housing, and a fourth center line, said fourth centerline being colinear with said third center line;

wherein said suction valve bore transition area has an elongated cross-section substantially perpendicular to said first centerline and with a long axis substantially perpendicular to a plane containing said first, second, third and fourth centerlines;

wherein said discharge valve bore transition area has an elongated cross-section substantially perpendicular to said second centerline and with a long axis substantially perpendicular to a plane containing said first, second, third and fourth centerlines;

wherein said cylinder bore transition area has elongated cross-sections substantially perpendicular to said third centerline and with a long axis substantially perpendicular to a plane containing said first, second, third and fourth centerlines;

wherein said access bore transition area has elongated cross-sections substantially perpendicular to said fourth centerline, each said elongated access bore cross-section having a long axis substantially perpendicular to a plane containing said first, second, third and fourth centerlines; and wherein each said bore transition area has at least one adjacent chamfer for smoothing bore interfaces.

2. The plunger pump housing of claim 1 wherein said second and third centerlines form an angle within a range of approximately 85 degrees and approximately 95 degrees.

3. A valve stem guide and spring retainer assembly for use in the plunger pump housing of claim 1, the assembly comprising a discharge valve lower stem guide for placement substantially within a discharge bore transition area of the plunger pump housing, said discharge valve lower stem guide comprising a body having first and second ends and a transverse cross-section, said first end comprising a shoulder mating surface for mating with a corresponding shoulder within said discharge bore, and said second end comprising at least one lateral alignment groove, a centered cylindrical guide stem hole extending longitudinally between said first and second ends, and at least one fluid passage extending longitudinally between said first and second ends;

a suction valve top stem guide and spring retainer for placement substantially opposite said discharge valve lower stem guide and aligned with a suction bore transition area of the plunger pump housing, said suction valve top stem guide and spring retainer comprising a body having first and second ends and a transverse cross-section, said first end comprising a shoulder mating surface for mating with a corresponding shoulder within said suction bore, and said second end comprising at least one lateral alignment groove for placement opposing said at least one discharge valve lower stem guide alignment groove to form at least one opposing lateral alignment groove pair, a centered cylindrical guide stem hole extending longitudinally between said first and second ends, and at least one fluid passage extending longitudinally between said first and second ends;

at least one side spacer having first and second parallel edges for insertion between grooves of said at least one opposing lateral alignment groove pair, said first and second parallel edges being spaced apart sufficiently to assure upon insertion simultaneous mating between shoulder mating surfaces of said discharge valve lower stem guide and said suction valve top stem guide and spring retainer and corresponding pump housing shoulders when the valve stem guide and spring retainer assembly is used in the plunger pump housing; and wherein said discharge valve lower stem guide and said suction valve top stem guide and spring retainer each have transverse cross-sections dimensioned to allow a close longitudinal sliding fit within, respectively, a corresponding cylindrical discharge bore transition area and a corresponding cylindrical suction bore transition area of the plunger pump housing.

4. The valve stem guide and spring retainer assembly of claim 3 comprising two lateral alignment groove pairs and two side spacers.

5. The valve stem guide and spring retainer assembly of claim 4 additionally comprising an access bore cover plug for covering said access bore and for spacing said two side spacers a predetermined distance apart.

6. A plunger pump housing for use with a valve stem guide and spring retainer assembly, the plunger pump housing comprising:

a suction valve bore having a portion with substantially circular cross-sections for accommodating a circular suction valve, a cylindrical transition area, a shoulder corresponding to a suction valve spring retainer shoulder mating surface, and a first centerline;

a discharge valve bore having a portion with substantially circular cross-sections for accommodating a circular discharge valve, a cylindrical transition area, a shoulder corresponding to a discharge valve lower stem guide shoulder mating surface, and a second centerline, said first and second centerlines being colinear;

a cylinder bore having a proximal packing area and a distal transition area, said packing area having a substantially circular cross-section and a third centerline, said third centerline being coplanar with said first and second centerlines; and an access bore having a cylindrical transition area with elongated cross-sections for facilitating access to interior portions of the plunger pump housing, and a fourth center line, said fourth centerline being colinear with said third center line;

wherein said suction valve bore transition area has an elongated cross-section substantially perpendicular to said first centerline and with a long axis substantially perpendicular to a plane containing said first, second, third and fourth centerlines;

wherein said discharge valve bore transition area has an elongated cross-section substantially perpendicular to said second centerline and with a long axis substantially perpendicular to a plane containing said first, second, third and fourth centerlines;

wherein said cylinder bore transition area has elongated cross-sections substantially perpendicular to said third centerline and with a long axis substantially perpendicular to a plane containing said first, second, third and fourth centerlines;

wherein said access bore transition area has elongated cross-sections substantially perpendicular to said fourth centerline, each said elongated access bore cross-section having a long axis substantially perpendicular to a plane containing said first, second, third and fourth centerlines; and wherein each said bore transition area has at least one adjacent chamfer for smoothing bore interfaces.

7. The plunger pump housing of claim 6 wherein said second and third centerlines form an angle within a range of approximately 85 degrees and approximately 95 degrees.

8. A valve stem guide and spring retainer assembly for use in the plunger pump housing of claim 6, the assembly comprising a discharge valve lower stem guide for placement substantially within a discharge bore transition area of the plunger pump housing, said discharge valve lower stem guide comprising a body having first and second ends and a transverse cross-section, said first end comprising a shoulder mating surface for mating with a corresponding shoulder within said discharge bore, and said second end comprising at least one lateral alignment groove, a centered cylindrical guide stem hole extending longitudinally between said first and second ends, and at least one fluid passage extending longitudinally between said first and second ends;

a suction valve spring retainer for placement substantially opposite said discharge valve lower stem guide and aligned with a suction bore transition area of the plunger pump housing, said suction valve spring retainer comprising a body having first and second ends and a transverse cross-section, said first end comprising a shoulder mating surface for mating with a corresponding shoulder within said suction bore, and said second end comprising at least one lateral alignment groove for placement opposing said at least one discharge valve lower stem guide alignment groove to form at least one opposing lateral alignment groove pair, and at least one fluid passage extending longitudinally between said first and second ends;

at least one side spacer having first and second parallel edges for insertion between grooves of said at least one opposing lateral alignment groove pair, said first and second parallel edges being spaced apart sufficiently to assure upon insertion simultaneous mating between shoulder mating surfaces of said discharge valve lower stem guide and said suction valve spring retainer and corresponding pump housing shoulders when the valve stem guide and spring retainer assembly is used in the plunger pump housing; and wherein said discharge valve lower stem guide and said suction valve spring retainer each have transverse cross-sections dimensioned to allow a close longitudinal sliding fit within, respectively, a corresponding cylindrical discharge bore transition area and a corresponding cylindrical suction bore transition area of the plunger pump housing.

9. The valve stem guide and spring retainer assembly of claim 8 comprising two lateral alignment groove pairs and two side spacers.

10. The valve stem guide and spring retainer assembly of claim 9 additionally comprising an access bore cover plug for covering said access bore and for spacing said two side spacers a predetermined distance apart.

11. A plunger pump housing for use with a valve stem guide and spring retainer assembly, the plunger pump housing comprising:

a suction valve bore having a portion with substantially circular cross-sections for accommodating a circular suction valve, a transition area, and a first centerline;

a discharge valve bore having a portion with substantially circular cross-sections for accommodating a circular discharge valve, a cylindrical transition area, a shoulder corresponding to a discharge valve lower stem guide mating surface, and a second centerline, said first and second centerlines being colinear;

a cylinder bore having a proximal packing area and a distal transition area, said packing area having a substantially circular cross-section and a third centerline, said third centerline being coplanar with said first and second centerlines; and an access bore having a cylindrical transition area with elongated cross-sections for facilitating access to interior portions of the plunger pump housing, and a fourth center line, said fourth centerline being colinear with said third center line;

wherein said suction valve bore transition area has an elongated cross-section substantially perpendicular to said first centerline and with a long axis substantially perpendicular to a plane containing said first, second, third and fourth centerlines;

wherein said discharge valve bore transition area has an elongated cross-section substantially perpendicular to said second centerline and with a long axis substantially perpendicular to a plane containing said first, second, third and fourth centerlines;

wherein said cylinder bore transition area has elongated cross-sections substantially perpendicular to said third centerline and with a long axis substantially perpendicular to a plane containing said first, second, third and fourth centerlines;

wherein said access bore transition area has elongated cross-sections substantially perpendicular to said fourth centerline, each said elongated access bore cross-section having a long axis substantially perpendicular to a plane containing said first, second, third and fourth centerlines; and wherein each said bore transition area has at least one adjacent chamfer for smoothing bore interfaces.

12. The plunger pump housing of claim 11 wherein said second and third centerlines form an angle within a range of approximately 85 degrees and approximately 95 degrees.

13. A valve stem guide and spring retainer assembly for use in the plunger pump housing of claim 11, the assembly comprising a discharge valve lower stem guide for placement substantially within a discharge bore transition area of the plunger pump housing, said discharge valve lower stem guide comprising a body having first and second ends and a transverse cross-section, said first end comprising a shoulder mating surface for mating with a corresponding shoulder within said discharge bore, and said second end comprising at least one lateral alignment groove, a centered cylindrical guide stem hole extending longitudinally between said first and second ends, and at least one fluid passage extending longitudinally between said first and second ends;

a suction valve top stem guide and spring retainer for placement substantially opposite said discharge valve lower stem guide and aligned with a suction bore transition area of the plunger pump housing, said suction valve top stem guide and spring retainer comprising a body having first and second ends and a transverse cross-section, said first end comprising a chamfer mating surface for mating with a chamfer adjacent said suction bore, and said second end comprising at least one lateral alignment groove for placement opposing said at least one discharge valve lower stem guide alignment groove to form at least one opposing lateral alignment groove pair, a centered cylindrical guide stem hole extending longitudinally between said first and second ends, and at least one fluid passage extending longitudinally between said first and second ends;

at least one side spacer having first and second parallel edges for insertion between grooves of said at least one opposing lateral alignment groove pair, said first and second parallel edges being spaced apart sufficiently to assure upon insertion mating between said shoulder mating surface of said discharge valve lower stem guide and said corresponding pump housing shoulder, simultaneous with mating between said suction valve top stem guide and spring retainer chamfer mating surface and said corresponding chamfer adjacent said suction bore when the valve stem guide and spring retainer assembly is used in the plunger pump housing; and wherein said discharge valve lower stem guide and said suction valve top stem guide and spring retainer each have transverse cross-sections dimensioned to allow a close longitudinal sliding fit within, respectively, a corresponding cylindrical discharge bore transition area and a corresponding cylindrical suction bore transition area of the plunger pump housing.

14. The valve stem guide and spring retainer assembly of claim 13 comprising two lateral alignment groove pairs and two side spacers.

15. The valve stem guide and spring retainer assembly of claim 14 additionally comprising an access bore cover plug for covering said access bore and for spacing said two side spacers a predetermined distance apart.

16. A valve stem guide and spring retainer assembly for use in the plunger pump housing of claim 11, the assembly comprising a discharge valve lower stem guide for placement substantially within a discharge bore transition area of the plunger pump housing, said discharge valve lower stem guide comprising a body having first and second ends and a transverse cross-section, said first end comprising a shoulder mating surface for mating with a corresponding shoulder within said discharge bore, and said second end comprising at least one lateral alignment groove, a centered cylindrical guide stem hole extending longitudinally between said first and second ends, and at least one fluid passage extending longitudinally between said first and second ends;

a suction valve spring retainer for placement substantially opposite said discharge valve lower stem guide and aligned with a suction bore transition area of the plunger pump housing, said suction valve spring retainer comprising a body having first and second ends and a transverse cross-section, said first end comprising a chamfer mating surface for mating with a chamfer adjacent said suction bore, and said second end comprising at least one lateral alignment groove for placement opposing said at least one discharge valve lower stem guide alignment groove to form at least one opposing lateral alignment groove pair, and at least one fluid passage extending longitudinally between said first and second ends;

at least one side spacer having first and second parallel edges for insertion between grooves of said at least one opposing lateral alignment groove pair, said first and second parallel edges being spaced apart sufficiently to assure upon insertion mating between shoulder mating surface of said discharge valve lower stem guide and said corresponding pump housing shoulder, simultaneous with mating between said suction valve spring retainer chamfer mating surface and said corresponding chamfer adjacent said suction bore when the valve stem guide and spring retainer assembly is used in the plunger pump housing; and wherein said discharge valve lower stem guide and said suction valve spring retainer each have transverse cross-sections dimensioned to allow a close longitudinal sliding fit within, respectively, a corresponding cylindrical discharge bore transition area and a corresponding cylindrical suction bore transition area of the plunger pump housing.

17. The valve stem guide and spring retainer assembly of claim 16 comprising two lateral alignment groove pairs and two side spacers.

18. The valve stem guide and spring retainer assembly of claim 17 additionally comprising an access bore cover plug for covering said access bore and for spacing said two side spacers a predetermined distance apart.

19. A plunger pump housing for use with a valve stem guide and spring retainer assembly, the plunger pump housing comprising:

a suction valve bore having a portion with substantially circular cross-sections for accommodating a circular suction valve, a cylindrical transition area, a shoulder corresponding to a suction valve top stem guide and spring retainer shoulder mating surface, and a first centerline;

a discharge valve bore having a portion with substantially circular cross-sections for accommodating a circular discharge valve, a cylindrical transition area, a shoulder corresponding to a discharge valve lower stem guide shoulder mating surface and a second centerline, said first and second centerlines being colinear;

a cylinder bore having a proximal packing area and a distal transition area, said packing area having a substantially circular cross-section and a third centerline, said third centerline being coplanar with said first and second centerlines; and an access bore having a cylindrical transition area with elongated cross-sections for facilitating access to interior portions of the plunger pump housing, and a fourth center line, said fourth centerline being colinear with said third center line;

wherein said cylinder bore transition area has elongated cross-sections substantially perpendicular to said third centerline and with a long axis substantially perpendicular to a plane containing said first, second, third and fourth centerlines;

wherein said access bore transition area has elongated cross-sections substantially perpendicular to said fourth centerline, each said elongated access bore cross-sections having a long axis substantially perpendicular to a plane containing said first, second, third and fourth centerlines; and wherein each said bore transition area has at least one adjacent chamfer for smoothing bore interfaces.

20. The plunger pump housing of claim 19 wherein said second and third centerlines form an angle within a range of approximately 85 degrees and approximately 95 degrees.

21. A valve stem guide and spring retainer assembly for use in the plunger pump housing of claim 19, the assembly comprising a discharge valve lower stem guide for placement substantially within a discharge bore transition area of the plunger pump housing, said discharge valve lower stem guide comprising a body having first and second ends and a transverse cross-section, said first end comprising a shoulder mating surface for mating with a corresponding shoulder within said discharge bore, and said second end comprising at least one lateral alignment groove, a centered cylindrical guide stem hole extending longitudinally between said first and second ends, and at least one fluid passage extending longitudinally between said first and second ends;

a suction valve top stem guide and spring retainer for placement substantially opposite said discharge valve lower stem guide and aligned with a suction bore transition area of the plunger pump housing, said suction valve top stem guide and spring retainer comprising a body having first and second ends and a transverse cross-section, said first end comprising a shoulder mating surface for mating with a corresponding shoulder within said suction bore, and said second end comprising at least one lateral alignment groove for placement opposing said at least one discharge valve lower stem guide alignment groove to form at least one opposing lateral alignment groove pair, a centered cylindrical guide stem hole extending longitudinally between said first and second ends, and at least one fluid passage extending longitudinally between said first and second ends;

at least one side spacer having first and second parallel edges for insertion between grooves of said at least one opposing lateral alignment groove pair, said first and second parallel edges being spaced apart sufficiently to assure upon insertion simultaneous mating between shoulder mating surfaces of said discharge valve lower stem guide and said suction valve top stem guide and spring retainer and corresponding pump housing shoulders when the valve stem guide and spring retainer assembly is used in the plunger pump housing; and wherein said discharge valve lower stem guide and said suction valve top stem guide and spring retainer each have transverse cross-sections dimensioned to allow a close longitudinal sliding fit within, respectively, a corresponding cylindrical discharge bore transition area and a corresponding cylindrical suction bore transition area of the plunger pump housing.

22. The valve stem guide and spring retainer assembly of claim 21 comprising two lateral alignment groove pairs and two side spacers.

23. The valve stem guide and spring retainer assembly of claim 22 additionally comprising an access bore cover plug for covering said access bore and for spacing said two side spacers a predetermined distance apart.

24. A valve stem guide and spring retainer assembly for use in the plunger pump housing of claim 19, the assembly comprising a discharge valve lower stem guide for placement substantially within a discharge bore transition area of the plunger pump housing, said discharge valve lower stem guide comprising a body having first and second ends and a transverse cross-section, said first end comprising a shoulder mating surface for mating with a corresponding shoulder within said discharge bore, and said second end comprising at least one lateral alignment groove, a centered cylindrical guide stem hole extending longitudinally between said first and second ends, and at least one fluid passage extending longitudinally between said first and second ends;

a suction valve spring retainer for placement substantially opposite said discharge valve lower stem guide and aligned with a suction bore transition area of the plunger pump housing, said suction valve spring retainer comprising a body having first and second ends and a transverse cross-section, said first end comprising a shoulder mating surface for mating with a corresponding shoulder within said suction bore, and said second end comprising at least one lateral alignment groove for placement opposing said at least one discharge valve lower stem guide alignment groove to form at least one opposing lateral alignment groove pair, and at least one fluid passage extending longitudinally between said first and second ends;

at least one side spacer having first and second parallel edges for insertion between grooves of said at least one opposing lateral alignment groove pair, said first and second parallel edges being spaced apart sufficiently to assure upon insertion simultaneous mating between shoulder mating surfaces of said discharge valve lower stem guide and said suction valve spring retainer and corresponding pump housing shoulders when the valve stem guide and spring retainer assembly is used in the plunger pump housing; and wherein said discharge valve lower stem guide and said suction valve spring retainer each have transverse cross-sections dimensioned to allow a close longitudinal sliding fit within, respectively, a corresponding cylindrical discharge bore transition area and a corresponding cylindrical suction bore transition area of the plunger pump housing.

25. The valve stem guide and spring retainer assembly of claim 24 comprising two lateral alignment groove pairs and two side spacers.

26. The valve stem guide and spring retainer assembly of claim 25 wherein each said side spacer is dimensioned to fit closely within said plunger pump housing and a plunger inserted for use within said housing.

27. The valve stem guide and spring retainer assembly of claim 25 additionally comprising an access bore cover plug for covering said access bore and for spacing said two side spacers a predetermined distance apart.

* * * * *